US008297483B2

(12) United States Patent
Korakh et al.

(10) Patent No.: US 8,297,483 B2
(45) Date of Patent: Oct. 30, 2012

(54) LIQUID DISPENSER

(75) Inventors: Eliav Korakh, Hod Hasharon (IL); Emanuel Honen, Rishon Leion (IL); Reuben Koutal, Tel Aviv (IL)

(73) Assignees: Eliav Korakh, Hod Hasharon (IL); Emanuel Honen, Rishon Lezion (IL)

( * ) Notice: Subject to any disclaimer, the term of this patent is extended or adjusted under 35 U.S.C. 154(b) by 1267 days.

(21) Appl. No.: 10/559,735

(22) PCT Filed: Jun. 6, 2004

(86) PCT No.: PCT/IL2004/000481

§ 371 (c)(1),
(2), (4) Date: Aug. 2, 2006

(87) PCT Pub. No.: WO2004/108539

PCT Pub. Date: Dec. 16, 2004

(65) Prior Publication Data

US 2006/0278668 A1 Dec. 14, 2006

Related U.S. Application Data

(60) Provisional application No. 60/476,366, filed on Jun. 5, 2003.

(51) Int. Cl.
*B67D 3/00* (2006.01)

(52) U.S. Cl. ..... 222/547; 222/188; 222/479; 222/495; 222/500; 222/559

(58) Field of Classification Search ..... 222/188, 222/479, 495–497, 500, 509, 544, 547, 559, 222/561–564

See application file for complete search history.

(56) References Cited

U.S. PATENT DOCUMENTS 2,038,418 A 4/1936 Conner
4,261,485 A 4/1981 Borg
4,358,057 A * 11/1982 Burke ..... 239/333
4,778,087 A 10/1988 Desai
4,804,116 A 2/1989 Ball
4,930,689 A 6/1990 Stumpf
5,299,718 A 4/1994 Shwery
5,350,090 A 9/1994 McClure
5,390,832 A 2/1995 Lombardo
5,680,970 A 10/1997 Smith et al.
5,785,196 A 7/1998 Montgomery
(Continued)

*Primary Examiner* — J. Casimer Jacyna

(74) *Attorney, Agent, or Firm* — Merchant & Gould P.C.

(57) ABSTRACT

Liquid dispenser for dispensing a carbonated liquid from a container, the liquid dispenser including a compartment, a container sealing region, a compartment sealing region, and a valve, the compartment extending upwardly from a neck portion of the container, the neck portion and the compartment defining an opening to the atmosphere between the compartment and the neck portion, the container sealing region being located between the neck portion and the opening, the compartment sealing region being located between the compartment and the opening, the valve being movable within the compartment, from a closed position pressed toward the neck portion, to an open position away from the neck portion, the valve including a first surface facing the compartment, a second surface facing the opening, a first valve sealing region, a second valve sealing region, and a channel extending from the neck portion to the compartment, the first valve sealing region matching the container sealing region, for preventing passage of fluids between the neck portion and the opening, when the valve is in the closed position, the second valve sealing region matching the compartment sealing region, for preventing passage of fluids between the compartment and the opening, when the valve is in the closed position, the channel enabling passage of fluid from the neck portion to the compartment.

12 Claims, 22 Drawing Sheets

U.S. PATENT DOCUMENTS 5,918,779 A 7/1999 Ventura
5,924,606 A 7/1999 Huizing
6,006,955 A * 12/1999 Bouix ..... 222/373
6,068,165 A 5/2000 Minihane et al.
6,089,272 A 7/2000 Brand et al.
6,145,712 A * 11/2000 Benoist ..... 222/402.1
6,581,808 B2 6/2003 De Laforcade

* cited by examiner

LIQUID DISPENSER

FIELD OF THE DISCLOSED TECHNIQUE

The disclosed technique relates to liquid dispensers in general, and to methods and systems for dispensing a carbonated beverage from a container, in particular.

BACKGROUND OF THE DISCLOSED TECHNIQUE

When the cap of a container of a carbonated beverage, such as plain soda water, soda water with additives, beer, and the like, is removed from the container, the gas tends to escape from the container, thereby causing the original taste of the carbonated beverage to deteriorate. Thus, it is desirable to prevent the escape of the gas from the container, when the container is not being used.

Methods and systems for preventing the gas to escape the container, are known in the art. These systems generally employ a valve of some kind, which normally seals the mouth of the container and when actuated by a user, the valve opens the mouth of the container to the atmosphere, thereby allowing the user to dispense the liquid from the container, under the pressure of the gas.

U.S. Pat. No. 5,918,779 issued to Ventura and entitled "Valve Assembly for Supplying Pressurized Liquid From a Container", is directed to a valve assembly for dispensing pressurized liquid from a Polyethylene Terepthalate (PET) bottle. The valve assembly includes a body, a valve member and a dip tube. The body includes a transverse partition wall, an axial conduit, a supplying orifice, a supplying spout, a top opening, a dome-cap and a tube-retaining socket. The valve member includes a membrane-like disc, a plurality of resilient arms, a closing piece and an actuating stem. The dome-cap includes a dome and an actuating projection.

The transverse wall is conical. The dome-cap is coupled with the top opening. The axial conduit is located at the center of the body and communicates with the supplying orifice. The supplying orifice communicates with the supplying spout. The tube-retaining socket is coupled to the lower portion of the body. The membrane-like disc is located between the tube-retaining socket and the transverse partition wall. The dip tube is coupled with the tube-retaining socket and enters into the PET bottle, to communicate with the liquid.

The closing piece is located on top of the resilient arms and the actuating stem is coupled with the top portion of the closing piece. The actuating stem is located below the actuating projection. The user pushes the dome-cap down, wherein the actuating projection makes contact with the actuating stem and moves the closing piece down against the resilient arms. The liquid flows up through the dip tube, a valve opening generated between the closing piece and the transverse partition wall, through the axial conduit, the supplying orifice and out through the supplying spout.

U.S. Pat. No. 5,390,832 issued to Lombardo and entitled "Apparatus for Dispensing a Pressurized Liquid", is directed to an apparatus for dispensing a pressurized liquid from a container. The apparatus includes a head member, a valve member, a liner, a shaft, a cover, a locking ring, a locking pin and a knob. The head member includes a bottle attachment cylinder, a siphon tube, a flow passage, a conical valve chamber and a pour spout. The bottle attachment cylinder includes internal threads for screwing the apparatus on a bottle. The siphon tube is coupled with the flow passage and the siphon tube enters into the bottle to be immersed into the liquid. The flow passage is located between the siphon tube and the apex of the conical valve chamber. The pour spout is coupled with the wide portion of the conical valve chamber.

The valve member is conical and fits within the conical valve chamber. The liner includes a converging portion which is located between the valve member and the inner surface of the conical valve chamber and a diverging portion. The cover includes internal threads for being screwed on an end of the head member. An end of the diverging portion is clamped between the end of the head member and the cover, to seal the space between the conical valve chamber, the flow passage and the pour spout.

The shaft includes an enlarged diameter segment and a smaller diameter segment. The enlarged diameter segment is externally threaded, in order to be screwed into a threaded bore of the valve member. The smaller diameter portion of the shaft passes through the cover and is fastened to the knob, by the locking pin. The locking ring is located between the cover and the knob, to prevent axial movement of the shaft. Since the liner restricts rotation of the valve member, rotation of the knob causes the valve member to move axially within the conical valve chamber, thereby allowing the liquid to flow from the siphon tube, through the flow passage and the conical valve chamber, out through the pour spout.

U.S. Pat. No. 5,350,090 issued to McClure and entitled "Beverage Dispenser", is directed to a dispenser for dispensing a pressurized liquid from a container. The dispenser includes a head, a valve body, a trigger handle, a tube, a tube seal and an outlet. The lower portion of the head includes internal threads to be screwed onto a neck of a bottle. When the head is assembled on the bottle, the tube seal seals between the neck of the bottle, the head and the tube. The tube extends from the neck to the bottom of the bottle. The trigger handle is coupled with the valve body and the valve body is located on the top of the tube. When the trigger handle is pressed, the valve body allows the liquid to flow from the tube and through the valve body, out through the outlet.

U.S. Pat. No. 5,299,718 issued to Shwery and entitled "Bottle Closures", is directed to a bottle closure to temporarily prevent a pressurized beverage to escape from a bottle. The closure includes a one-piece molded housing, a one-piece molded valve stem, a one-piece molded resilient push top, a circular underside and a spout. The one-piece molded housing includes an internal thread to be screwed on a top portion of a bottle. The valve stem includes a ball at one end thereof and a frusto-conical sealing skirt at another end thereof. The frusto-conical sealing skirt includes a rigid sealing skirt and a flexible sealing skirt. The circular underside includes rigid frusto-conical seat for mating with the rigid sealing skirt and with the flexible sealing skirt. The one-piece molded resilient push top includes a dome-type portion and a cylindrical extension. The cylindrical extension includes a socket for engaging with the ball of the valve stem.

Normally, the one-piece molded resilient push top pulls the valve stem up against the circular underside, such that the frusto-conical sealing skirt seals the rigid frusto-conical seat, thereby preventing the beverage to escape. When the user pushes the one-piece resilient push top down, the frusto-conical sealing skirt loses contact with the rigid frusto-conical seat and allows the beverage to flow out through the spout.

U.S. Pat. No. 4,804,116 issued to Ball and entitled "Valve for Dispensing Fluid From a Container", is directed to a valve to dispense a liquid from a container, under a gas pressure. The valve includes a screw cap, a hollow grommet and a hollow valve rod. The screw cap includes internal threads for the valve to be screwed onto a neck of the container. The screw cap includes an aperture to hold the hollow grommet. The hollow grommet includes a skirt which fits on a dip tube.

The dip tube enters the bottle to seek the low level of the liquid in the container. The hollow valve rod includes a flange. The hollow grommet is located within the screw cap and the hollow valve rod is located within the hollow grommet. The cap screw includes an annular passageway and a pipe union. The pipe union is coupled with a pressurized gas source.

Normally, the hollow grommet forces the flange against itself, thereby preventing the liquid to escape from the container. When the hollow valve rod is tilted sideways, a path for the liquid and a path for the pressurized gas to flow from the pressurized gas source through the annular passageway to the container is formed, thereby causing the liquid to flow out of the container under gas pressure.

U.S. Pat. No. 4,930,689 issued to Stumpf and entitled "Resealable Cap for a Container", is directed to a cap for a container for allowing a carbonated liquid to flow out of the container, by pushing a button. The cap includes a body member, a spout, a button, a ventilation tube, an insert tube, two sealing members, a plunger, a compression spring, a retaining washer and a guide cylinder. The cap includes internal threads to be screwed onto a neck of the container. The guide cylinder is located at the bottom portion of the insert tube. The guide cylinder includes a plurality of projections. The insert tube is located within the cap and when the cap is screwed onto the container, the insert tube locates within the neck of the container and one of the sealing members seals between the insert tube and the neck.

The button is located at one end of the plunger and the other sealing member is located at the other end of the plunger. The plunger is located within the insert tube, such that the button locates on top of the cap and the sealing member seals the rim of the insert tube. The retaining washer is located at the lower portion of the plunger and the compression spring is located between the retaining washer and the projections of the guide cylinder, thereby forcing the sealing member to seal the rim of the guide cylinder. The button is pushed against the force of the compression spring, thereby unsealing the rim of the guide cylinder and opening a path for the carbonated liquid to flow out of the container through the spout. Meanwhile, air enters the container through the ventilation tube, thereby facilitating the flow of the carbonated liquid.

U.S. Pat. No. 5,924,606 issued to Huizing and entitled "Pouring Spout with Refill Prevention Device", is directed to a pouring spout which allows pouring of a liquid from a bottle and prevents refilling of the bottle. The pouring spout includes a neck part, a closing part and a pouring spout housing. The pouring spout housing includes an upper part, a lower part, a cylinder member and a movable weight. The upper part includes a conical surface which diverges toward the lower part. The lower part includes a cylindrical part at the lower portion thereof. The cylindrical part includes a plurality of casing openings. The cylinder member is located within the cylindrical part and can move there within. The movable weight is located between the cylinder member and the conical surface.

The pouring spout is assembled on a neck of the bottle, such that the upper part, the lower part, the cylinder member and the movable weight are located between the neck of the bottle and the closing part. The neck part includes a lower groove and an upper groove. The lower groove mates with a groove on the periphery of the neck of the bottle and the upper groove mates with another groove on the periphery of the upper part. Thus, the neck part together with the upper part, the lower part, the cylinder member and the movable weight are coupled with the neck of the bottle and can not be removed without damaging the pouring spout. The closing part is coupled with the neck part by a breakable element. After breaking the breakable element, the closing part can be screwed onto the neck part.

When the bottle is located in an upright position, the movable weight forces the cylinder member toward the cylindrical part, thereby closing the casing openings. When the bottle is tilted at an angle which exceeds the angle of the conical surface, the movable weight and the cylinder member move toward the upper part, the casing openings open and the liquid pours out of the bottle.

U.S. Pat. No. 5,680,970 issued to Smith et al., and entitled "Self Closing Dispensing Valve Biased by Resilient Fingers", is directed to a dispensing valve for pouring liquid from a liquid-containing bag. The dispensing valve includes a valve body, a cap and a valve member. The valve body includes a rim, a front wall, a guide channel, a frusto-conical section and a cylindrical outlet section. The cylindrical outlet section includes a bearing hole. The front wall is provided with finger grips. The lower portion of the cylindrical outlet section is cut away to form a rectangular outlet orifice. The cap includes a circular rear wall. The circular rear wall includes a plurality of resilient flexible fingers and a plurality of inlet holes. The valve member includes a camming surface, a cylindrical portion, a conical rear portion, an actuating portion and a valve boss.

The actuating portion is located within the bearing hole and the bearing hole acts as a guide for the actuation portion. The valve boss slides within the guide channel, thereby opening and closing the rectangular outlet orifice. The rim is coupled with a fitting of the liquid-containing bag. The cap is located within the valve member, such that the resilient flexible fingers make contact with the camming surface. When the actuating portion is pushed against the finger grips, the rectangular outlet orifice opens and the liquid flows out from the liquid-containing bag, through the inlet holes and the rectangular outlet orifice. When the actuating portion is released, the resilient flexible fingers force the valve member against the camming surface, such that the actuating portion moves out through the bearing hole and the valve boss obstructs the rectangular outlet orifice, thereby preventing the liquid to flow out of the liquid-containing bag.

U.S. Pat. No. 5,785,196 issued to Montgomery and entitled "Closure for a Pressurized Container", is directed to a closure for closing the neck of a container package which contains a pressurized liquid, such as a carbonated beverage. The closure includes a planar top, an annular skirt, an annular flange, a plurality of circumferentially spaced radially passages and a plurality of circumferentially spaced axially extending passages. The annular skirt extends downwardly from the planar top and the annular skirt includes an internal thread for screwing the closure on the external threads of the neck. The annular flange extends downwardly from the planar top and diverges toward an inner wall of the neck, to make contact with the inner wall.

When the closure is screwed onto the neck, the container pressure within the container package applies a sealing force on the annular flange, thereby moving the annular flange outwardly toward the inner wall and sealing the annular flange against the inner wall. When the force is applied to the annular flange outwardly relative to the planar top, the air trapped between the annular flange and the planar top exits through the circumferentially spaced radially passages, thereby allowing the annular flange to move outwardly. When the closure is unthreaded, the container pressure is relieved through the circumferentially spaced axially extending passages.

SUMMARY OF THE DISCLOSED TECHNIQUE

It is an object of the disclosed technique to provide a novel device for dispensing a carbonated liquid from a container, which overcomes the disadvantages of the prior art.

In accordance with the disclosed technique, there is thus provided a liquid dispenser for dispensing a carbonated liquid from a container. The liquid dispenser includes a compartment, a container sealing region, a compartment sealing region, and a valve. The compartment extends upwardly from a neck portion of the container. The neck portion and the compartment define an opening to the atmosphere between the compartment and the neck portion. The container sealing region is located between the neck portion and the opening. The compartment sealing region is located between the compartment and the opening.

The valve is movable within the compartment, from a closed position pressed toward the neck portion, to an open position away from the neck portion. The valve includes a first surface facing the compartment, a second surface facing the opening, a first valve sealing region, a second valve sealing region, and a channel extending from the neck portion to the compartment. The first valve sealing region matches the container sealing region, for preventing passage of fluids between the neck portion and the opening, when the valve is in the closed position. The second valve sealing region matches the compartment sealing region, for preventing passage of fluids between the compartment and the opening, when the valve is in the closed position. The channel enables passage of fluid from the neck portion to the compartment.

In accordance with another aspect of the disclosed technique, there is thus provided a liquid dispenser for dispensing a carbonated liquid from a container. The liquid dispenser includes a compartment located above a neck portion of the container, a fluid channel which couples the compartment with the neck portion, a compartment sealing region for sealing the compartment against an opening to the atmosphere, a container sealing region for sealing the neck portion against the opening, and an elastic valve. The elastic valve is firmly attached to the compartment at the compartment sealing region. The elastic valve is elastically deformable to move from a closed position pressed toward the container sealing region, to an open position away from the container sealing region.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a valve which seals the mouth of a container containing a carbonated liquid, mainly due to a net force on a valve element, as a result of the gas pressure of the carbonated liquid. This net force is substantially equal to the vectorial sum of the forces acting on different sides of the valve element having different surface areas as a result of the gas and atmospheric pressure. When the container is tilted to a pouring position, the valve element lifts off the mouth due to the gravitational force of the valve element, the gravitational force of the carbonated liquid, or both, thereby allowing the carbonated liquid to flow out of the container under the gas pressure.

Figure 1A:
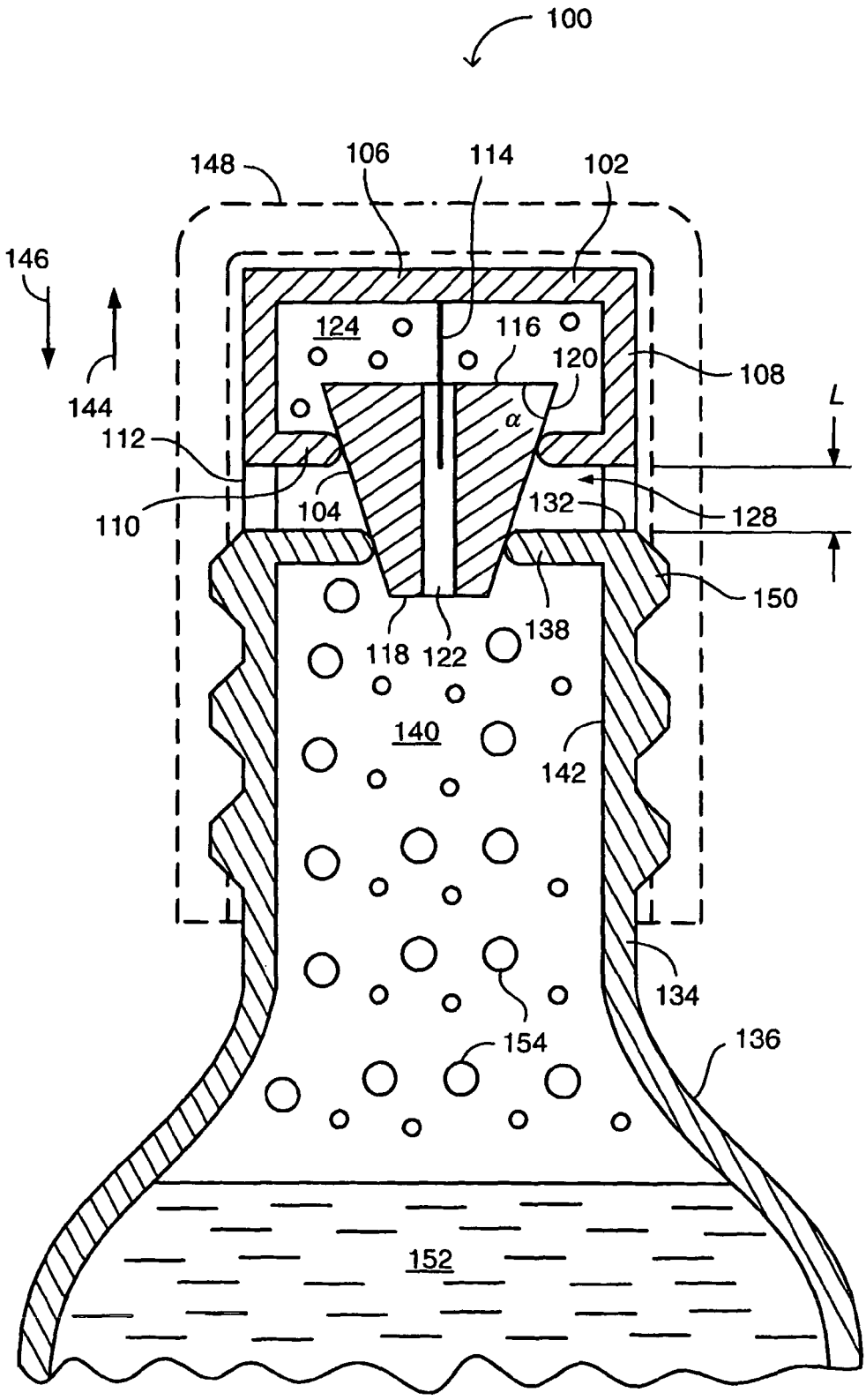
FIG. 1A is a schematic illustration of a cross section of a dispenser in a closed mode, constructed and operative in accordance with an embodiment of the disclosed technique.
Figure 1B:
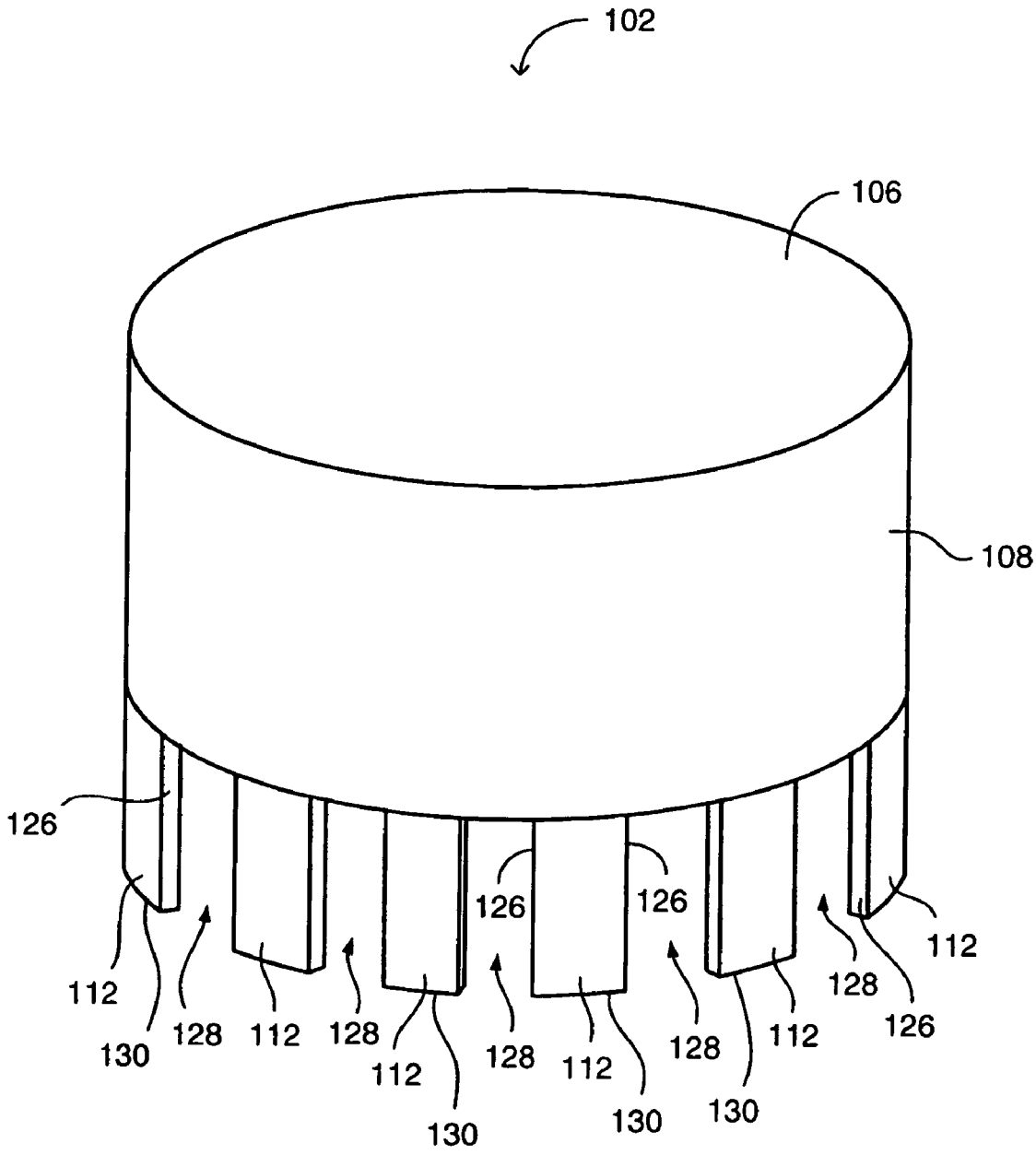
FIG. 1B is a schematic illustration in perspective, of the cover of the dispenser of FIG. 1A.
Figure 1E:
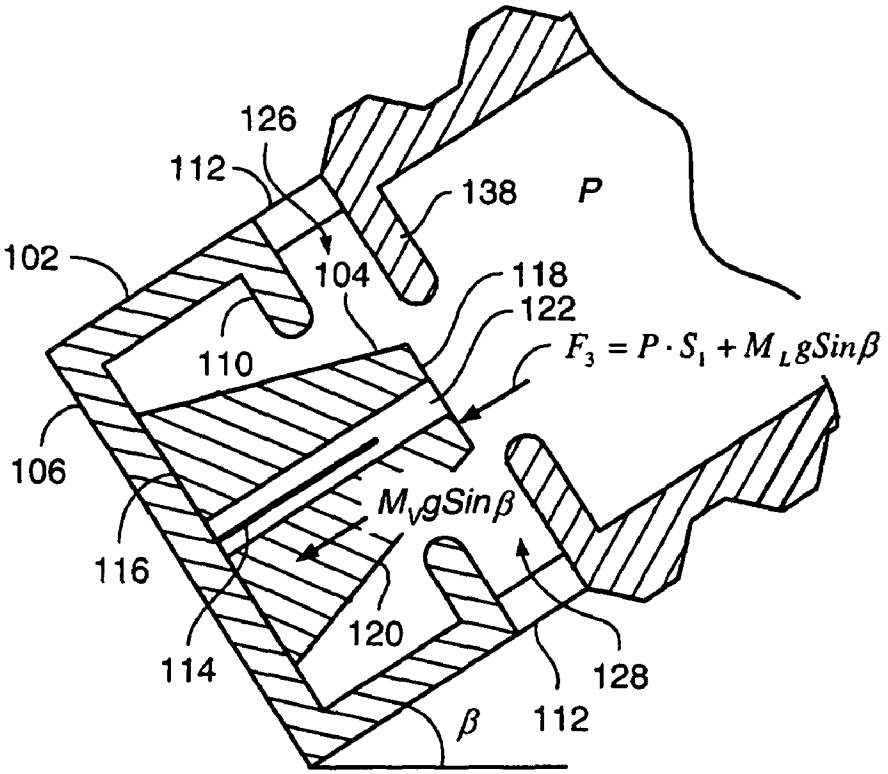
FIG. 1E is a schematic illustration of a free body diagram of the valve element of the dispenser of FIG. 1A, in a dispensing mode.
Figure 1C:
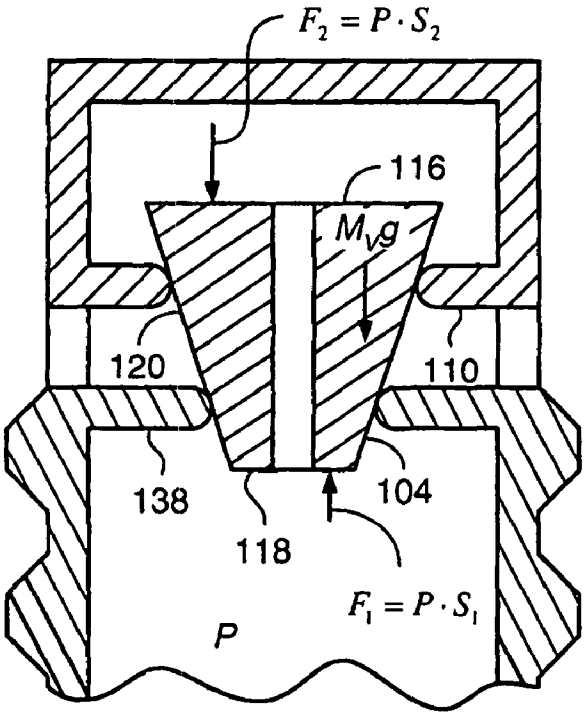
FIG. 1C is a schematic illustration of a free body diagram of the valve element of the dispenser of FIG. 1A.
Figure 1D:
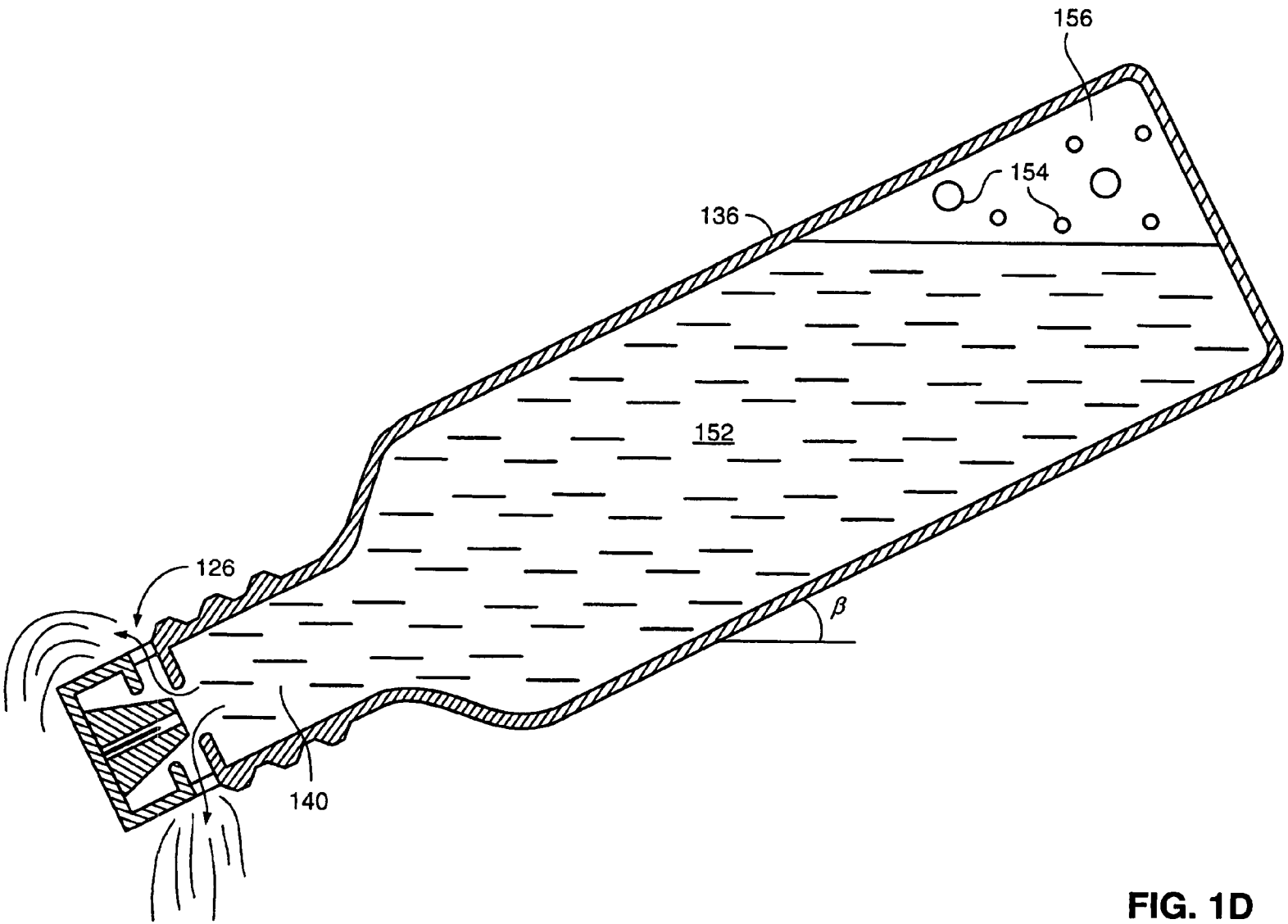
FIG. 1D is a schematic illustration of the dispenser of FIG. 1A, in a dispensing mode.
Figure 1F:
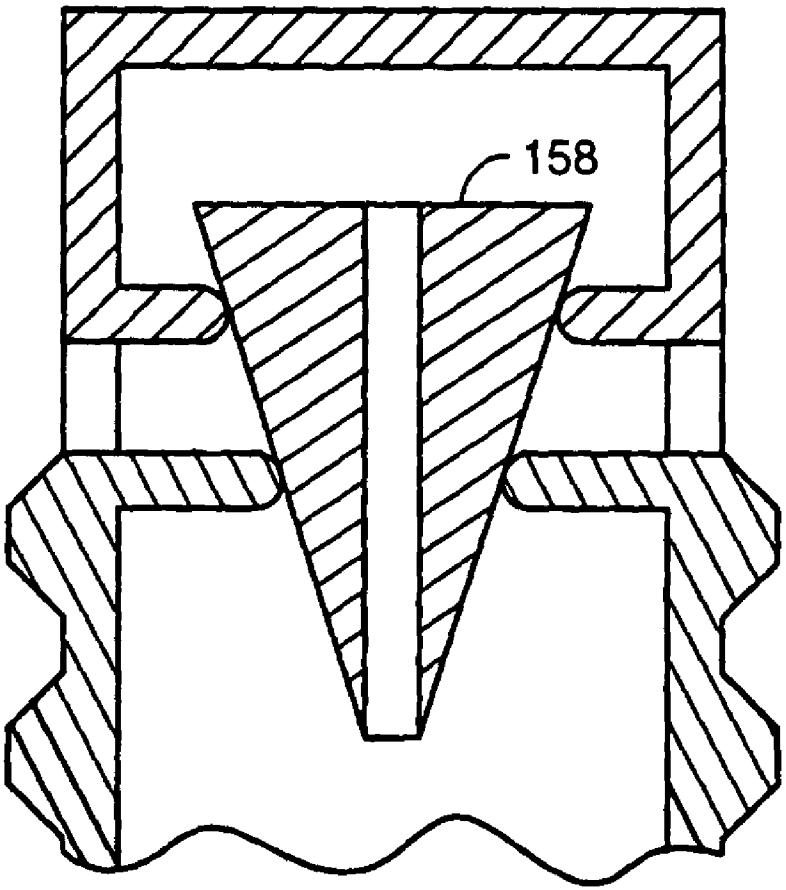
FIG. 1F is a schematic illustration of the valve element of the dispenser of FIG. 1A, constructed and operative in accordance with another embodiment of the disclosed technique.

Reference is now made to FIGS. 1A, 1B, 1C, 1D 1E and 1F. FIG. 1A is a schematic illustration of a cross section of a dispenser in a closed mode, generally referenced 100, constructed and operative in accordance with an embodiment of the disclosed technique. FIG. 1B is a schematic illustration in perspective, of the cover of the dispenser of FIG. 1A. FIG. 1C is a schematic illustration of a free body diagram of the valve element of the dispenser of FIG. 1A. FIG. 1D is a schematic illustration of the dispenser of FIG. 1A, in a dispensing mode. FIG. 1E is a schematic illustration of a free body diagram of the valve element of the dispenser of FIG. 1A, in a dispensing mode. FIG. 1F is a schematic illustration of the valve element of the dispenser of FIG. 1A, generally referenced 158, constructed and operative in accordance with another embodiment of the disclosed technique.

With reference to FIGS. 1A and 1B, dispenser 100 includes a cover 102 and a valve element 104. Cover 102 includes a head portion 106, a side wall 108, a pressure-building valve-seat 110, a plurality of ribs 112 and a guiding element 114. Valve element 104 is in shape of a frustum of a cone, having a cone angle α, a base 116, a vertex 118, a lateral surface 120 and a bore 122 (i.e., a channel from one side to the other). Each of cover 102 and guiding element 114 is made of a substantially rigid material, such as polymer, metal, glass, wood, and the like. Valve element 104 is made of a substantially flexible material, such as plastic, silicone, urethane, rubber (i.e., polymer), and the like.

Head portion 106 is substantially circular. Side wall 108 extends from head portion 106, in a direction substantially normal to head portion 106. Ribs 112 extend from side wall 108 in the direction of side wall 108. Pressure-building valve-seat 110 is in form of an annulus coupled with an inner surface (not shown) of side wall 108. The surface of pressure-building valve-seat 110 is substantially perpendicular to the inner surface of side wall 108. Pressure-building valve-seat 110, the inner surface of side wall 108 and the inner surface (not shown) of head portion 106, form a cover space 124. Inner edges 126 of ribs 112 form a plurality of openings 128.

Alternatively, the head portion is substantially in form of a hemisphere and the cover is devoid of the side wall. In this case, the cover space is formed by the concave side of the head portion and the cover valve-seat.

Guiding element 114 is coupled with the inner surface of head portion 106, at the center (not shown) of head portion 106. Guiding element 114 extends from head portion 106 in a direction substantially perpendicular to the inner surface of head portion 106. The outer diameter (not shown) of guiding element 114 is smaller than the inner diameter (not shown) of bore 122.

Outer edges 130 of ribs 112 are coupled with an edge 132 of a neck 134 of a container 136. Outer edges 130 can be coupled with edge 132 by fastening methods known in the art, such as by an adhesive, ultrasonic welding, brazing (for metallic parts), welding, electromagnetic forming, and the like. Neck 134 includes a container valve-seat 138.

Alternatively, ribs 112, side wall 108, pressure-building valve-seat 110 and container valve-seat 138 are integral parts of neck 134. In this case, head portion 106 is coupled with side wall 108, after placing valve element 104 on pressure-building valve-seat 110 and container valve-seat 138. Further alternatively, guiding element 114 can be an integral part of head portion 106.

Container valve-seat 138 is coupled with an inner wall 142 of neck 134. Container valve-seat 138 is substantially parallel with pressure-building valve-seat 110. The distance between container valve-seat 138 and pressure-building valve-seat 110 is designated by the letter L. An inner diameter (not shown) of pressure-building valve-seat 110 is larger than an inner diameter (not shown) of container valve-seat 138. Valve element 104 is located in such a position, that base 116 is located in cover space 124 and vertex 118 is located in a neck space 140, neck space 140 being defined by inner wall 142, container valve-seat 138 and the surface of a carbonated liquid 152 contained in container 136.

Cone angle α, the distance L between pressure-building valve-seat 110 and container valve-seat 138, and inner diameters (not shown) of pressure-building valve-seat 110 (i.e., compartment sealing region) and container valve-seat 138 (i.e., container sealing region) are selected such that lateral surface 120 (i.e., a second valve sealing region of lateral surface 120—not shown, and a first valve sealing region of lateral surface 120—not shown) is simultaneously in contact with both pressure-building valve-seat 110 and container valve-seat 138, respectively. Valve element 104 is assembled within cover 102, such that guiding element 114 is located within bore 122. Hence, valve element 104 can move on guiding element 114 in directions designated by arrows 144 and 146. A cap 148 having internal threads (not shown), can be screwed on neck 134 having external threads 150 compatible with the internal threads of cap 148. Carbonated liquid 152 generates gases 154 within neck space 140.

With further reference to FIG. 1C, $S_1$ is the net area of vertex 118 (i.e., excluding the base area of bore 122), $S_2$ is the net area of base 116 (i.e., excluding the base area of bore 122), $M_v$ is the mass of valve element 104, P is the pressure of gas 154 within neck space 140 and g is the gravitation constant. The weight of valve element 104, $M_v g$ acts on valve element 104 in direction 146. A force $F_1$ acts on vertex 118 in direction 144, as a result of pressure P of gas 154 within neck space 140, where, $$F_1 P \cdot S_1 \tag{1}$$

Gas 154 enters cover space 124 through bore 122 and thus a force $F_2$ acts on base 116 in direction 146, as a result of pressure P of gas 154 within cover space 124, where, $$F_2 = P \cdot S_2 \tag{2}$$

Since $$S_2 > S_1 \tag{3}$$

then $$F_2 > F_1 \tag{4}$$

Furthermore, since $$F_2 + M_v g > F_1 \tag{5}$$

valve element 104 tends to move in direction 146, thereby simultaneously sealing pressure-building valve-seat 110 and container valve-seat 138 and preventing gas 154 to escape neck space 140. At this stage cover space 124 is a pressurized chamber, formed by pressure-building valve-seat 110, head portion 106 and base 116, as a result of sealing of pressure-building valve-seat 110. It is noted that the resiliency of valve element 104 is such that even if cone angle α, distance L and the inner diameters of pressure-building valve-seat 110 and container valve-seat 138 are not exactly at the appropriate values, lateral surface 120 can still seal pressure-building valve-seat 110 and container valve-seat 138, simultaneously.

It is noted that the sealing action of valve element 104 is caused by a net force $F_n$, wherein, $$F_n=F_2+M_v g-F_1 \quad (6)$$

Since the weight of valve element 104, $M_v g$ is constant, a differential force $$F_d=F_2-F_1 \quad (7)$$

is the determining force in sealing pressure-building valve-seat 110 and container valve-seat 138. Furthermore, according to Equations 1, 2 and 7, $$F_d=P(S_2-S_1) \quad (8)$$

As long as pressure P is not zero (i.e., even though pressure P is substantially-low due to repeated consumption of carbonated liquid 152), still according to Equation 3, $F_d>0$ and $F_n>0$. Thus, whenever container 136 is in an upright position as in FIG. 1A, pressure-building valve-seat 110 and container valve-seat 138 are sealed and gas 154 remains within container 136.

With reference to FIGS. 1D and 1E, container 136 is tilted at a pouring angle β, wherein carbonated liquid 152 fills neck space 140 and gas 154 fills a bottom space 156 of container 136. Gas 154 in bottom space 156 is at pressure P. Carbonated liquid 152 has a mass $M_L$. At pouring angle β, a force $F_3$ acts on vertex 118 as a result of pressure P and the mass $M_L$ of carbonated liquid 152. Thus, $$F_3=P\cdot S_1+M_L g \sin\beta \quad (9)$$

Furthermore, a component of the weight of valve element 104 at pouring angle β and equivalent to $M_v g \sin\beta$, acts on valve element 104. Force $F_3$ together with the component of the weight of carbonated liquid $M_L$ at pouring angle β, force valve element 104 to move on guiding element 114 toward head portion 106, thereby lifting valve element 104 off of pressure-building valve-seat 110 and container valve-seat 138. In this position, pressure P of gas 154 forces carbonated liquid 152 out through openings 128.

When container 136 is returned to an upright position as in FIG. 1A, the weight of valve element 104 causes valve element 104 to move in direction 146 along guiding element 114 and for lateral surface 120 to make contact with pressure-building valve-seat 110 and container valve-seat 138. The differential force $F_d$ (Equation 7) further aids valve element 104 to seal pressure-building valve-seat 110 and container valve-seat 138, thereby preventing gas 154 to escape neck space 140.

It is noted that the disclosed technique allows a user to dispense a carbonated liquid from a container, without actuating the dispenser, wherein the dispenser seals the mouth of the container, when the container is not being used. The dispenser changes from a closed mode to a dispensing mode, when the container is tilted and from the dispensing mode back to the closed mode when the container is returned to the upright position, all transitions taking place automatically, without the intervention of the user.

At the pouring stage the carbonated liquid is forced out of the openings under the gas pressure. Thus, it is further noted that the flow of the carbonated liquid out of the container at the pouring stage, is substantially continuous and that no air breathing (as in a conventional opened cap bottle), is necessary.

Instead of carbonated liquid, the container can contain a mixture of any chemical substance in a fluid phase and any propellant in a gaseous phase. The chemical substance can be for example, a paint solution, a substance which turns into foam when mixed with air, a substance which transfers from fluid to gas when it is depressurized, such as liquid natural gas (LNG), a substance which vaporizes when exits the container, such as deodorant, and the like. In any case, it is noted that the specific gravity of the valve element must be sufficiently high in order to overcome the differential force $F_d$ (Equation 7), and thus allow the fluid to exit the container.

Alternatively, only the portions of lateral surface 120 which serve to seal container valve-seat 138 and pressure-building valve-seat 110 are formed with the cone angle α, and other portions of lateral surface 120 are in form of a prism whose base is a polygon, such as square, rectangle, triangle, pentagon, hexagon, or a close curve, such as circle, ellipse, and the like. With reference to FIG. 1F, valve element 158 is in form of a right circular cone instead of a frustum of a cone, such as valve element 116 (i.e., valve element 158 is devoid of a vertex similar to vertex 118).

Figure 2:
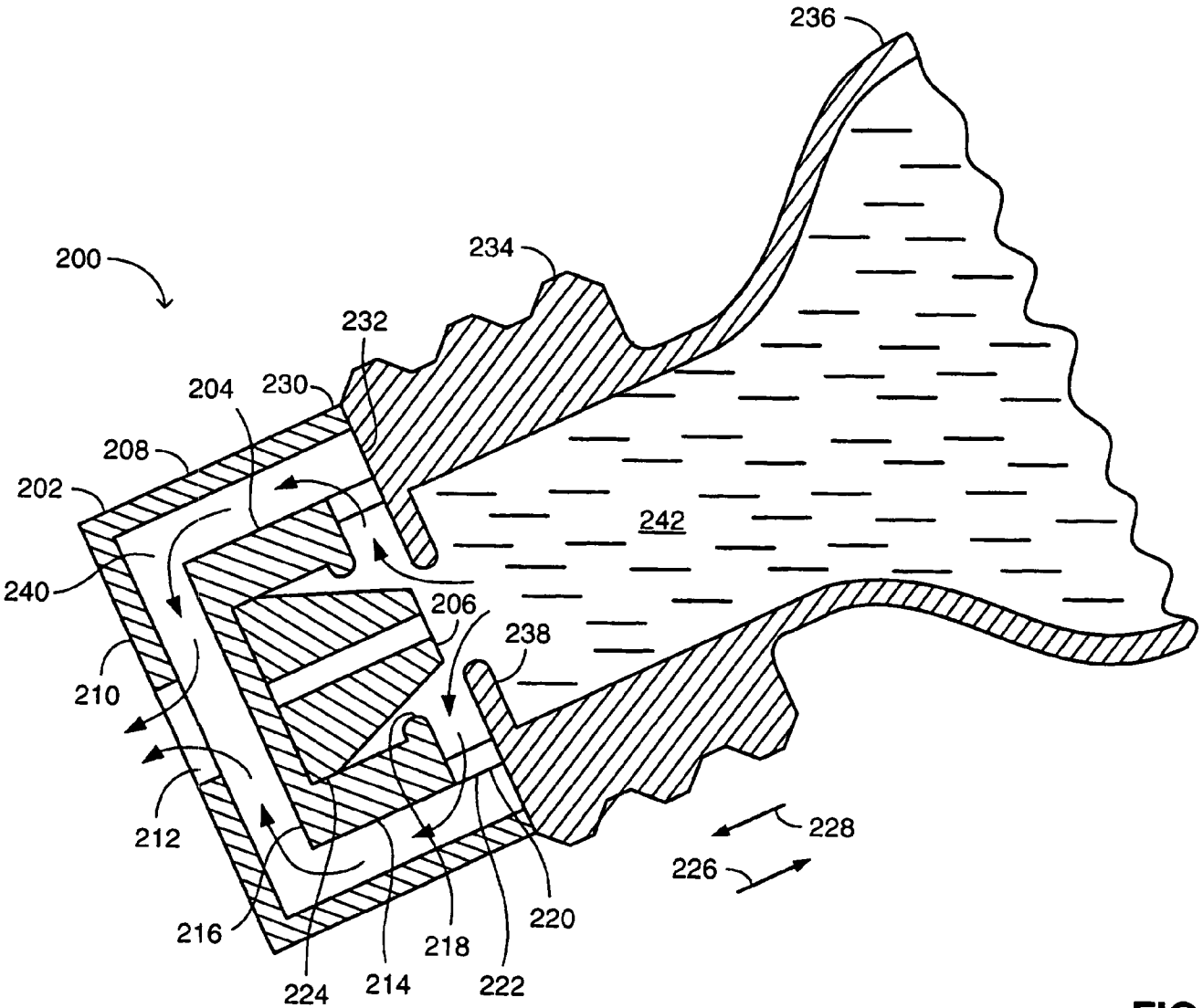
FIG. 2 is a schematic illustration of a cross section of a dispenser in a dispensing mode, constructed and operative in accordance with a further embodiment of the disclosed technique.

Reference is now made to FIG. 2, which is a schematic illustration of a cross section of a dispenser in a dispensing mode, generally referenced 200, constructed and operative in accordance with a further embodiment of the disclosed technique. Dispenser 200 includes a first cover 202 (i.e., outer cover), a second cover 204 (i.e., inner cover) and a valve element 206. First cover 202 includes a first side wall 208 and a first head portion 210. First head portion 210 is provided with at least one port 212. Second cover 204 includes a second side wall 214, a second head portion 216, a pressure-building valve-seat 218 and a plurality of ribs 220.

Second cover 204 is similar to cover 102 (FIGS. 1A and 1B), except that second side wall 214 is thicker than side wall 108. The inner edges (not shown) of ribs 220 form a plurality of openings 222. Valve element 206 is provided with a bearing portion 224, thereby allowing valve element 206 to slide within an inner surface (not shown) of second side wall 214, is directions designated by arrows 226 and 228.

First head portion 210 is substantially circular. First side wall 208 extends from first head portion 210, in a direction substantially perpendicular to first head portion 210. A tail portion 230 of first side wall 208, opposite to first head portion 210, is coupled with an edge 232 of a neck 234 of a container 236. Neck 234 includes a container valve-seat 238. The inner surfaces (not shown) of first cover 202 and the outer surfaces (not shown) of second cover 204 define an inter-cover space 240.

Alternatively, the first head portion is substantially in form of a hemisphere and the first cover is devoid of the first side wall. In this case, the inter-cover space is formed by the concave side of the first head portion and the outer surfaces of the first cover.

When container 236 is tilted as in FIG. 2, the weight of a carbonated liquid 242 contained in container 236, forces a base (not shown) of valve element 206 toward an inner surface (not shown) of second head portion 216, wherein valve element 206 lifts off of pressure-building valve-seat 218 and container valve-seat 238. Gases (not shown) located at a bottom space (not shown) of container 236 force carbonated liquid 242, to flow through openings 222 to inter-cover space 240 and out of container 236, through port 212.

When container 236 is moved to an upright position similar to that of FIG. 1A, the weight of valve element 206 causes valve element 206 to slide within the inner surface of second side wall 214 in direction 226. The lateral surfaces (not shown) of valve element 206 make contact with pressure-building valve-seat 218 and container valve-seat 238, and the pressure of the gas causes valve element 206 to seal pressure-building valve-seat 218 and container valve-seat 238, in a manner similar to the one described herein above in connection with FIG. 1A. Thus, when container 236 is in the upright position, the pressure of the gas within container 236 aids valve element 206 to seal container valve-seat 238 and prevent the escape of the gas from container 236.

Alternatively, container valve-seat 238 is an integral part of first side wall 208 and first head portion 210 is a separate part. Hence, after attaching second cover 204 to neck 234, first cover 202 is coupled with neck 234, and first head portion 210 is coupled with first side wall 208. Further alternatively, container valve-seat 238 and second side wall 214 are integral parts of neck 234, second head portion 216 is a separate part, and first head portion 210 is an integral part of first side wall 208. In this case, after inserting valve element 206 within second cover 204, second head portion 216 is coupled with second side wall 214 and first cover 202 is coupled with edge 232.

Figure 3A:
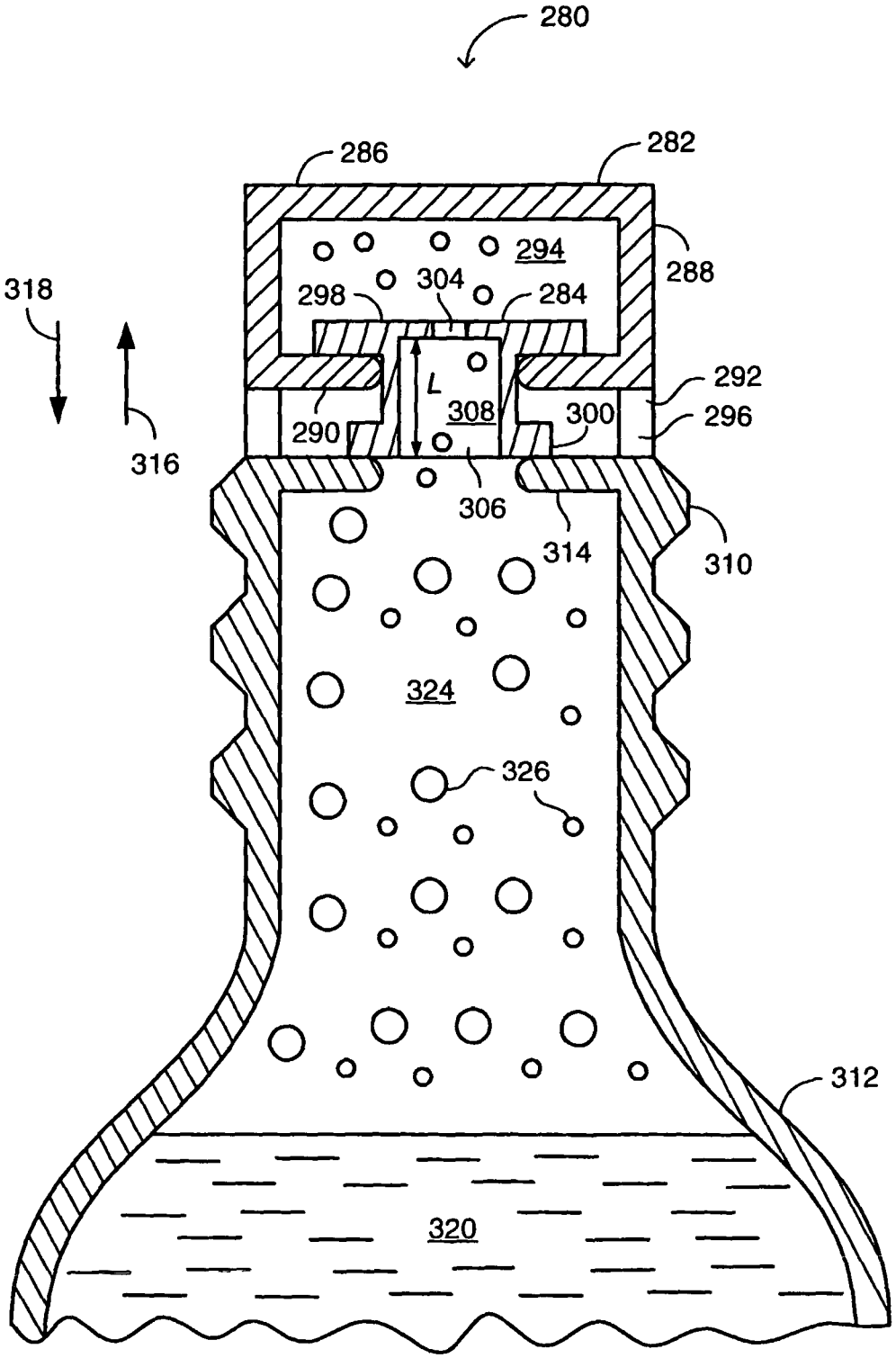
FIG. 3A is a schematic illustration of a cross section of a dispenser in a closed mode, constructed and operative in accordance with another embodiment of the disclosed technique.
Figure 3B:
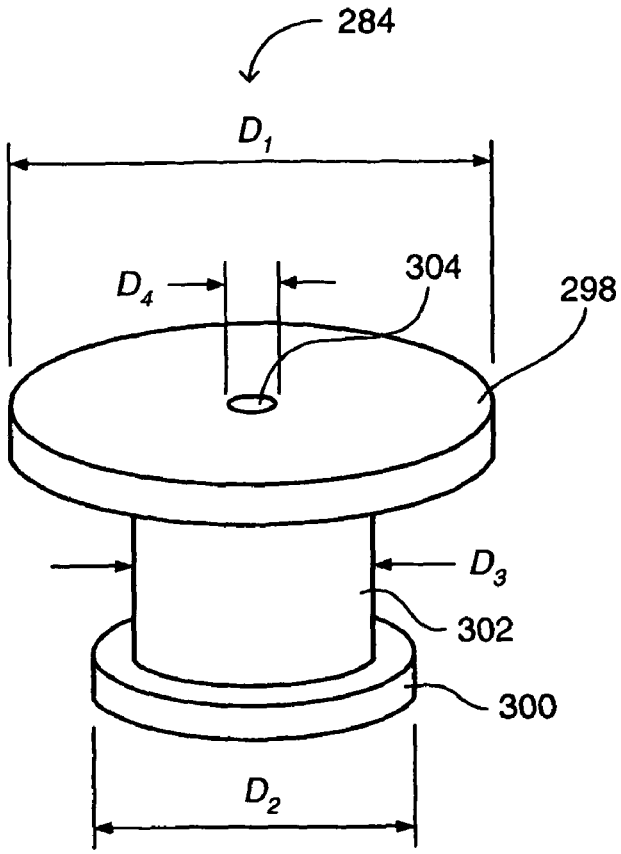
FIG. 3B is a schematic illustration in perspective, of the valve element of the dispenser of FIG. 3A.
Figure 3C:
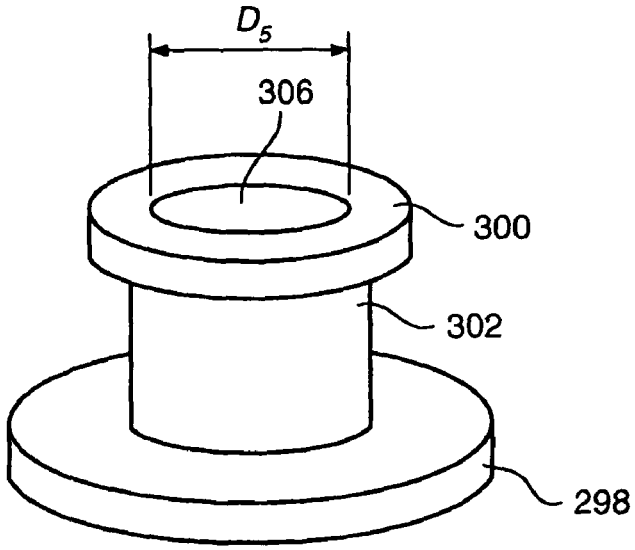
FIG. 3C is a schematic illustration in perspective, of the valve element of the dispenser of FIG. 3A at another view.
Figure 3D:
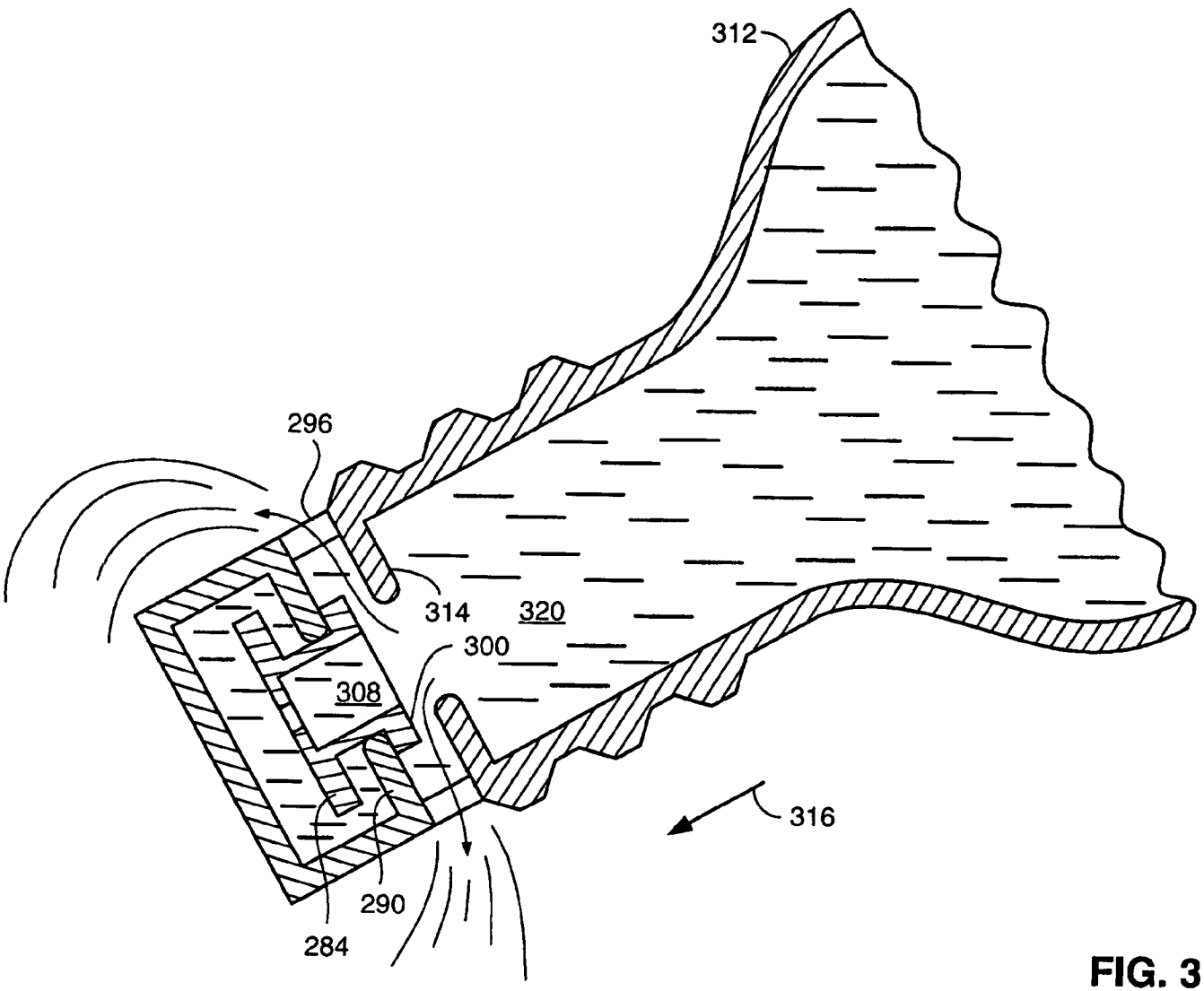
FIG. 3D is a schematic illustration of the dispenser of FIG. 3A, in a dispensing mode.

Reference is now made to FIGS. 3A, 3B, 3C and 3D. FIG. 3A is a schematic illustration of a cross section of a dispenser in a closed mode, generally referenced 280, constructed and operative in accordance with another embodiment of the disclosed technique. FIG. 3B is a schematic illustration in perspective, of the valve element of the dispenser of FIG. 3A. FIG. 3C is a schematic illustration in perspective, of the valve element of the dispenser of FIG. 3A at another view. FIG. 3D is a schematic illustration of the dispenser of FIG. 3A, in a dispensing mode.

With reference to FIGS. 3A, 3B and 3C, dispenser 280 includes a cover 282 and a valve element 284. Cover 282 includes a head portion 286, a side wall 288, a pressure-building valve-seat 290 and a plurality of ribs 292. Pressure-building valve-seat 290, an inner surface (not shown) of side wall 288 and an inner surface (not shown) of head portion 286, form a cover space 294. Ribs 292 form a plurality of openings 296. Valve element 284 is in form of a multi-faceted object (e.g., sewing bobbin) having a first end portion 298, a second end portion 300 and a mid-portion 302. The diameters of first end portion 298, second end portion 300 and mid-portion 302 are designated by $D_1$, $D_2$ and $D_3$, respectively, such that $$D_1 > D_2 \tag{10}$$

$$D_3 < D_1 \tag{11}$$

and $$D_3 < D_2 \tag{12}$$

First end portion 298 and second end portion 300 are provided with a first hole 304 and a second hole 306, respectively. The diameters of first hole 304 and second hole 306 are designated by $D_4$ and $D_5$, respectively, such that $$D_4 << D_5 \tag{13}$$

Furthermore, a depth of second hole 306 designated by L, is such that valve element 284 is provided with a cavity 308 within mid-portion 302.

A neck 310 of a container 312 is provided with a container valve-seat 314. The inner diameters (not shown) of pressure-building valve-seat 290 and container valve-seat 314 are substantially equivalent. $D_1$ is greater than an inner diameter (not shown) of pressure-building valve-seat 290. $D_3$ is substantially equal to the inner diameter of pressure-building valve-seat 290. $D_5$ is smaller than an inner diameter (not shown) of container valve-seat 314. $D_2$ is greater than the inner diameter of container valve-seat 314. Thus, the effective surface area (not shown) of first end portion 298 (i.e., the surface area of first end portion 298 excluding the area of first hole 304), is substantially greater than the effective surface area (not shown) of second end portion 300 [i.e., an annular area (not shown) defined by container valve-seat 314 and second hole 306].

Mid-portion 302 is located within pressure-building valve-seat 290, such that valve element 284 can move in directions designated by arrows 316 and 318. The outer edges (not shown) of ribs 292 are coupled with an edge (not shown) of neck 310. Container 312 contains a carbonated liquid 320 and a neck space 324 of container 312 contains a gas 326 at a pressure P.

When container 312 is in an upright position, the weight of valve element 284 forces valve element 284 to move in direction 318, wherein first end portion 298 and second end portion 300 make contact with pressure-building valve-seat 290 and with container valve-seat 314, respectively. Gas 326 enters cover space 294 through first hole 306 and second hole 304. The effective surface area of first end portion 298 exposed to gas 326 within cover space 294, is substantially greater than the effective surface area of second end portion 300 exposed to gas 326 in neck space 324. Thus, the force acting on first end portion 298 as a result of pressure P, is substantially greater than the force acting on second end portion 300 as a result of pressure P. The difference between these two forces, aids in sealing of pressure-building valve-seat 290 and of container valve-seat 314, by first end portion 298 and second end portion 300, respectively, thereby preventing gas 326 to escape from container 312.

With reference to FIG. 3D, container 312 is tilted at a pouring angle (not shown). At this pouring angle, carbonated liquid 320 fills cavity 308 and the weight of carbonated liquid 320 within cavity 308 forces valve element 284 to move in direction 316. Second end portion 300 lifts off of container valve-seat 314 and valve element 284 stops to move when second end portion 300 makes contact with pressure-building valve-seat 290. Gas 326 which is located at a bottom space (not shown) of container 312, forces carbonated liquid 320 out of container 312 through openings 296.

Valve element 284 is made of a substantially flexible material. Hence, valve element 284 can be assembled on cover 282 by inserting first end portion 298 through pressure-building valve-seat 290 and then cover 282 can be coupled with the edge of neck 310. Alternatively, ribs 292, side wall 288 and pressure-building valve-seat 290 are integral parts of neck 310, and head portion 286 is a separate part. In this case, valve element 284 can be assembled on cover 282 by inserting second end portion 300 through pressure-building valve-seat 290 and through cover space 294, and then head portion 286 can be coupled with side wall 288.

Alternatively, the cross section of the mid-portion of the valve element is any polygon or closed curve, such as square, rectangle, triangle, ellipse, and the like. Accordingly, the opening of the pressure-building valve-seat is made in a shape which matches the cross section of the mid-portion. Furthermore, the cross section of the mid-portion can be variable along direction 316. For example, this cross section can be in form of a cone or an undulating surface.

It is further noted that each of the first end portion and the second end portion can be in form of a polygon or a closed curve. Likewise, the opening of each of the pressure-building valve-seat and the container valve-seat can be made in shape of a polygon or a closed curve, such that the first end portion seals the pressure-building valve-seat and the second end portion seals the container valve-seat. It is noted that the perimeter of each of the first hole and the second hole can be in shape of any polygon or closed curve.

In the example set forth in FIG. 3A, the inner diameters of the container valve-seat and the pressure-building valve-seat are substantially equal. These two inner diameters however, can be different, provided the effective surface area of the first end portion is substantially greater than that of the second end portion and that the valve element can move between the two sealing and unsealing positions. It is further noted that $D_3$ must be smaller than $D_1$. However, $D_3$ can be substantially equal to or less than $D_2$.

Figure 4:
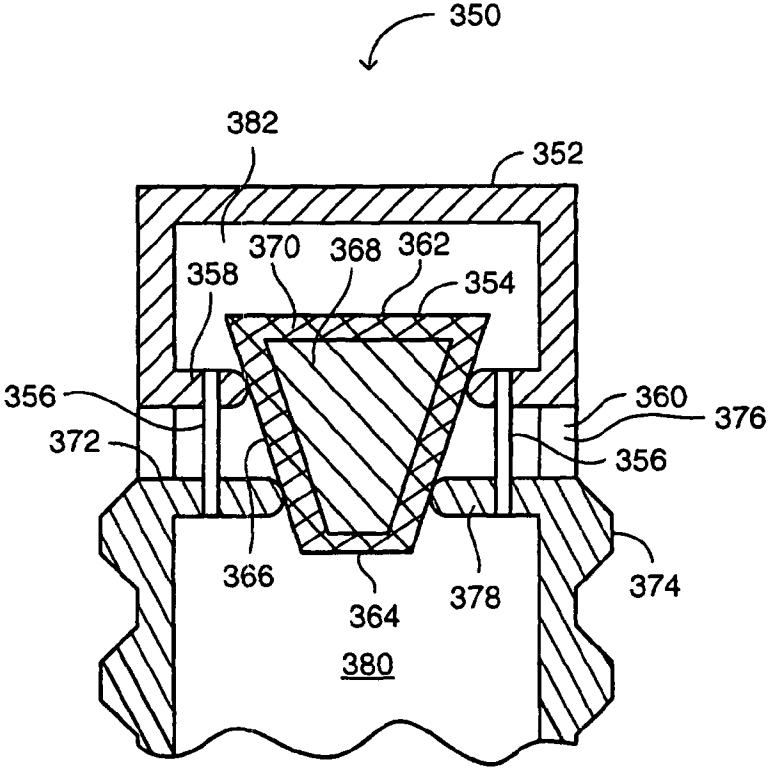
FIG. 4 is a schematic illustration of a cross section of a dispenser in a closed mode, constructed and operative in accordance with a further embodiment of the disclosed technique.

Reference is now made to FIG. 4, which is a schematic illustration of a cross section of a dispenser in a closed mode, generally referenced 350, constructed and operative in accordance with a further embodiment of the disclosed technique. Dispenser 350 includes a cover 352, a valve element 354 and a plurality of conduits 356. Cover 352 includes a pressure-building valve-seat 358 and a plurality of ribs 360. Valve element 354 is in shape of a frustum of a cone, having a base 362, a vertex 364 and a lateral surface 366. The surface area (not shown) of base 362 is greater than that of vertex 364. Valve element 354 includes an inner body 368 and an outer layer 370. The specific gravity of inner body 368 is sufficiently high in order to overcome the differential force $F_d$ (Equation 7), and thus allow the fluid to exit the container. Inner body 368 can be made of a material having a substantially large specific gravity, such as lead, iron, stone, glass, and the like.

Ribs 360 are coupled with an edge 372 of a neck 374 of a container (not shown). Inner edges (not shown) of ribs 360 form a plurality of openings 376. Neck 374 includes a container valve-seat 378. Outer layer 370 is made of a substantially flexible material similar to that of valve element 104, as described herein above in connection with FIG. 1A. Hence, lateral surface 366 can efficiently seal pressure-building valve-seat 358 and container valve-seat 378.

Pressure-building valve-seat 358 is coupled with container valve-seat 378 by conduits 356, such that a neck space 380 is in communication with a cover space 382. The container contains a carbonated liquid (not shown) and neck space 380 contains a gas (not shown) at a pressure P.

Outer layer 370 makes contact with pressure-building valve-seat 358 and with container valve-seat 378, due to the weight of inner body 368. The gas enters cover space 382 through conduits 356. Since the surface area of base 362 is greater than that of vertex 364, the force acting on base 362 as a result of pressure P of the gas, is greater than the force acting on vertex 364 as a result of pressure P of the gas. The difference in these two forces aids in sealing pressure-building valve-seat 358 and container valve-seat 378, thereby preventing the gas to escape from the container.

When the container is tilted at a pouring angle (not shown), the weight of the carbonated liquid causes valve element 354 to lift off of pressure-building valve-seat 358 and container valve-seat 378, and the carbonated liquid pours out of the container through openings 376. It is noted that since valve element 354 does not include any bore, such as bore 122 (FIG. 1A), the construction of valve element 354 is substantially simple. Furthermore, the weight of inner body 368 aids in moving valve element 354 toward pressure-building valve-seat 358 and container valve-seat 378, when the container is moved from a dispensing position to an upright position.

Figure 5:
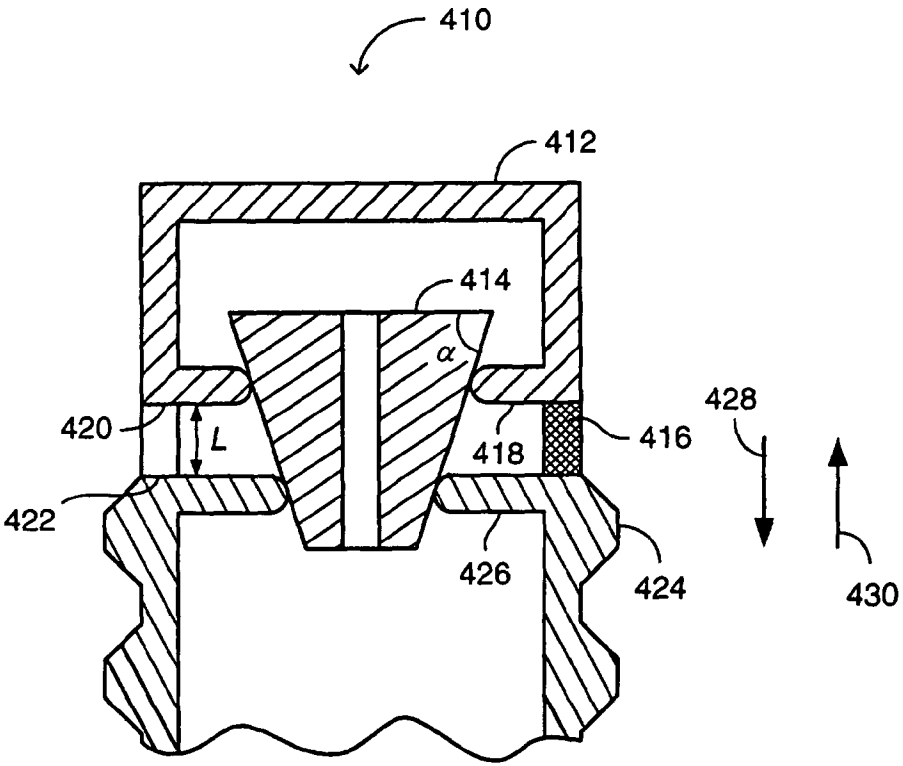
FIG. 5 is a schematic illustration of a cross section of a dispenser in a closed mode, constructed and operative in accordance with another embodiment of the disclosed technique.

Reference is now made to FIG. 5, which is a schematic illustration of a cross section of a dispenser in a closed mode, generally referenced 410, constructed and operative in accordance with another embodiment of the disclosed technique. Dispenser 410 includes a cover 412, a valve element 414 and a flexible rib 416. Cover 412 includes a pressure-building valve-seat 418. Valve element 414 is similar to valve element 104, as described herein above in connection with FIG. 1A. Valve element 414 has a cone angle α. An edge 420 of cover 412 is coupled with an edge 422 of a neck 424 of a container (not shown), by flexible ribs 416. Neck 424 includes a container valve-seat 426. A distance between pressure-building valve-seat 418 and container valve-seat 426 is designated by L.

Each of flexible ribs 416 is made of a resilient material, such as silicone, urethane, rubber (i.e., polymer), and the like, thereby allowing cover 412 to move in directions designated by arrows 428 and 430, relative to neck 424. If rigid ribs are employed instead of flexible ribs 416 and if the values of cone angle α, distance L, the inner diameters (not shown) and the concentricity (not shown) of the pressure-building valve-seat and the container valve-seat, and the like are not compatible, then the valve element can not completely seal the pressure-building valve-seat and the container valve-seat. However, if flexible ribs 416 are employed, then the movement of cover 412 in directions 428 and 430 compensates for the lack of compatibility of these values, thereby allowing valve element 414 to seal pressure-building valve-seat 418 and container valve-seat 426, effectively, due to the pressure of the gas.

In accordance with another aspect of the disclosed technique, a first area of a first side of a diaphragm is exposed to the gas pressure and a second area on a second side of the diaphragm, larger than the first area, is exposed to the same gas pressure. Since the force due to the gas pressure on the second side is greater than the one on the first side, the diaphragm closes against the mouth of the container and prevents the gas to escape. When the container is tilted at a pouring angle, the mass of the carbonated liquid forces the diaphragm open and the carbonated liquid emerges through this opening.

Figure 6A:
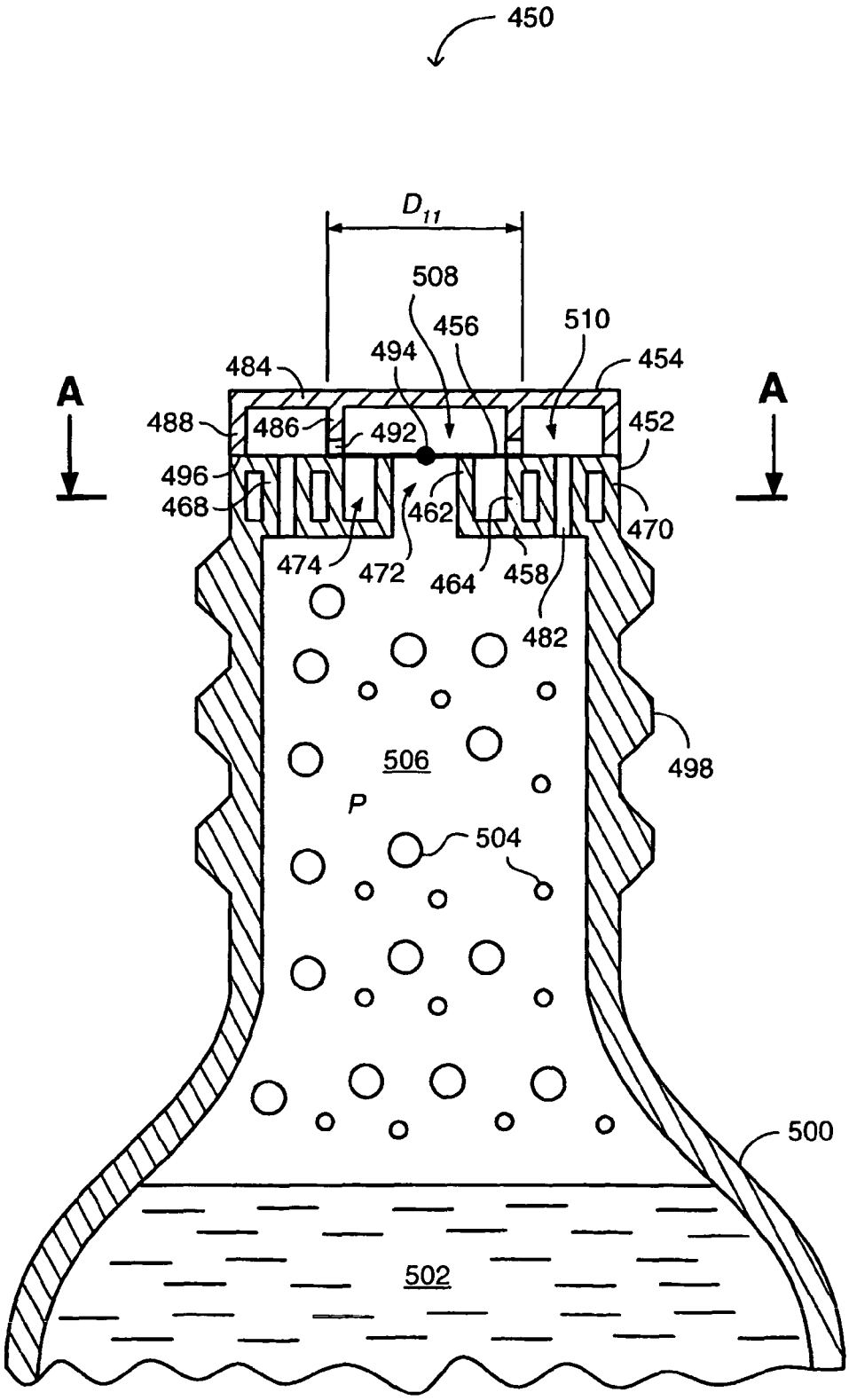
FIG. 6A is a schematic illustration of a side cross section of a dispenser in a closed mode, constructed and operative in accordance with a further embodiment of the disclosed technique.
Figure 6B:
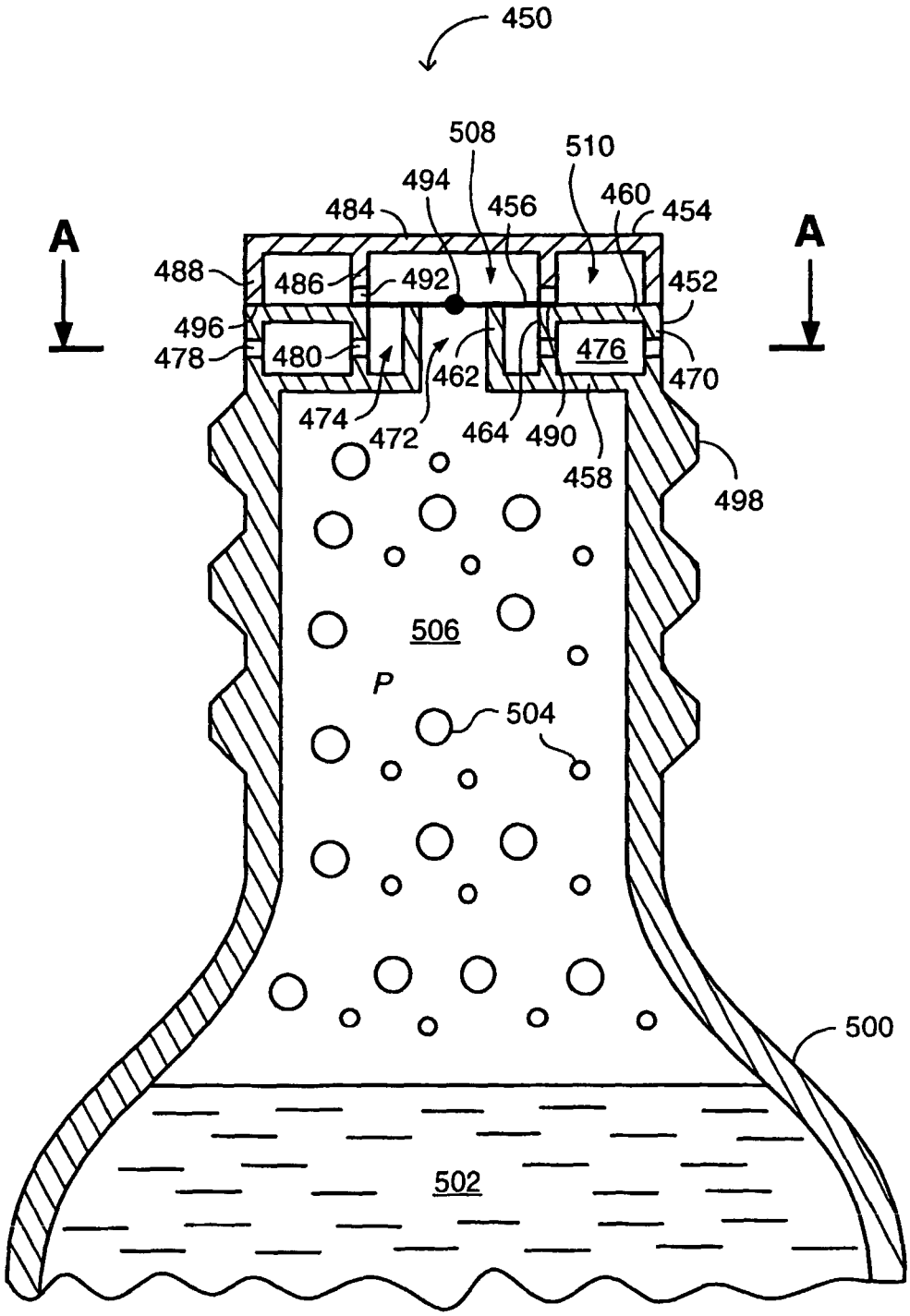
FIG. 6B is a schematic illustration of another side cross section of the dispenser of FIG. 6A.
Figure 6C:
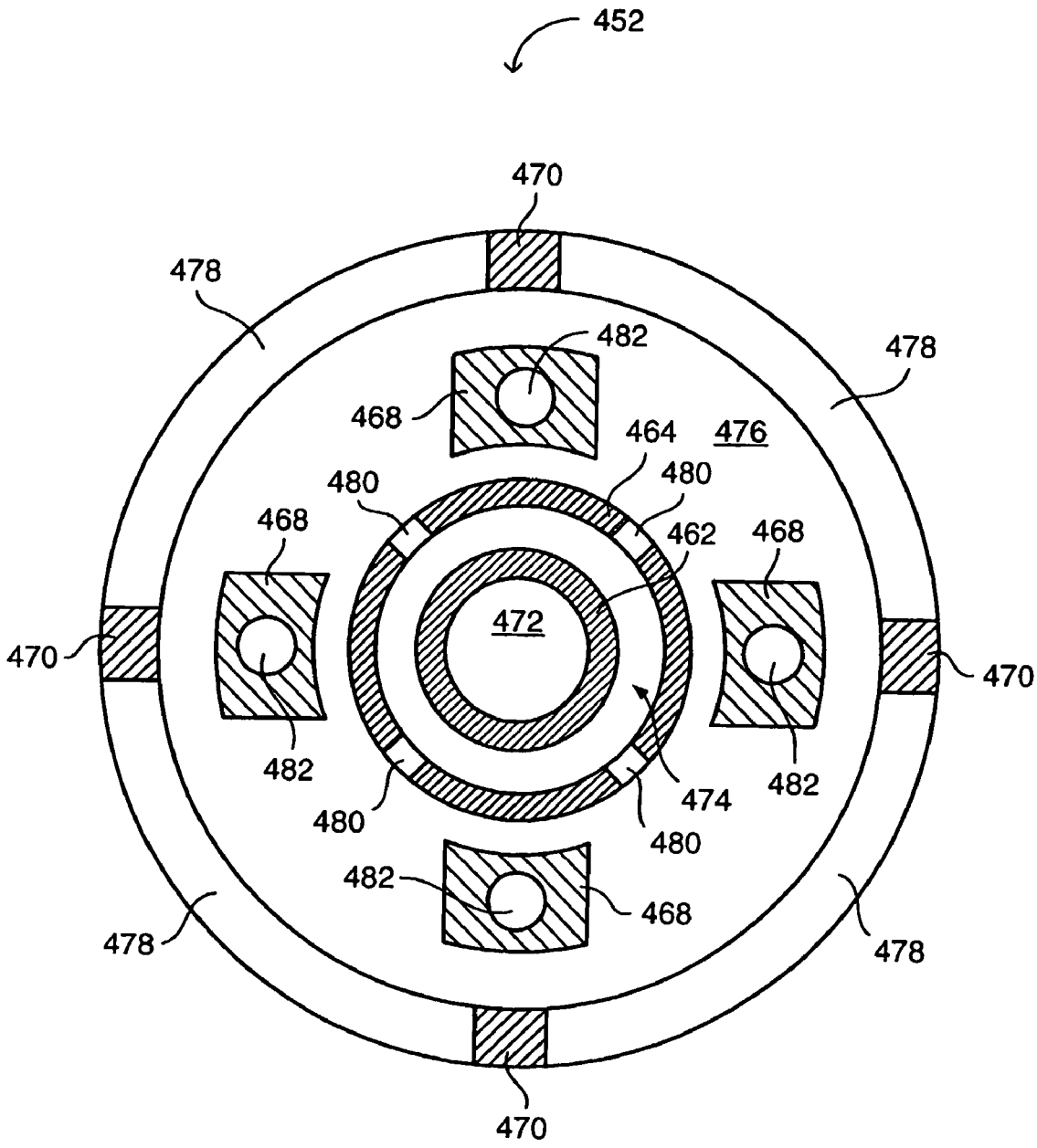
FIG. 6C is a schematic illustration of a top cross section (cross section A-A) of the dispenser of FIGS. 6A and 6B.
Figure 6D:
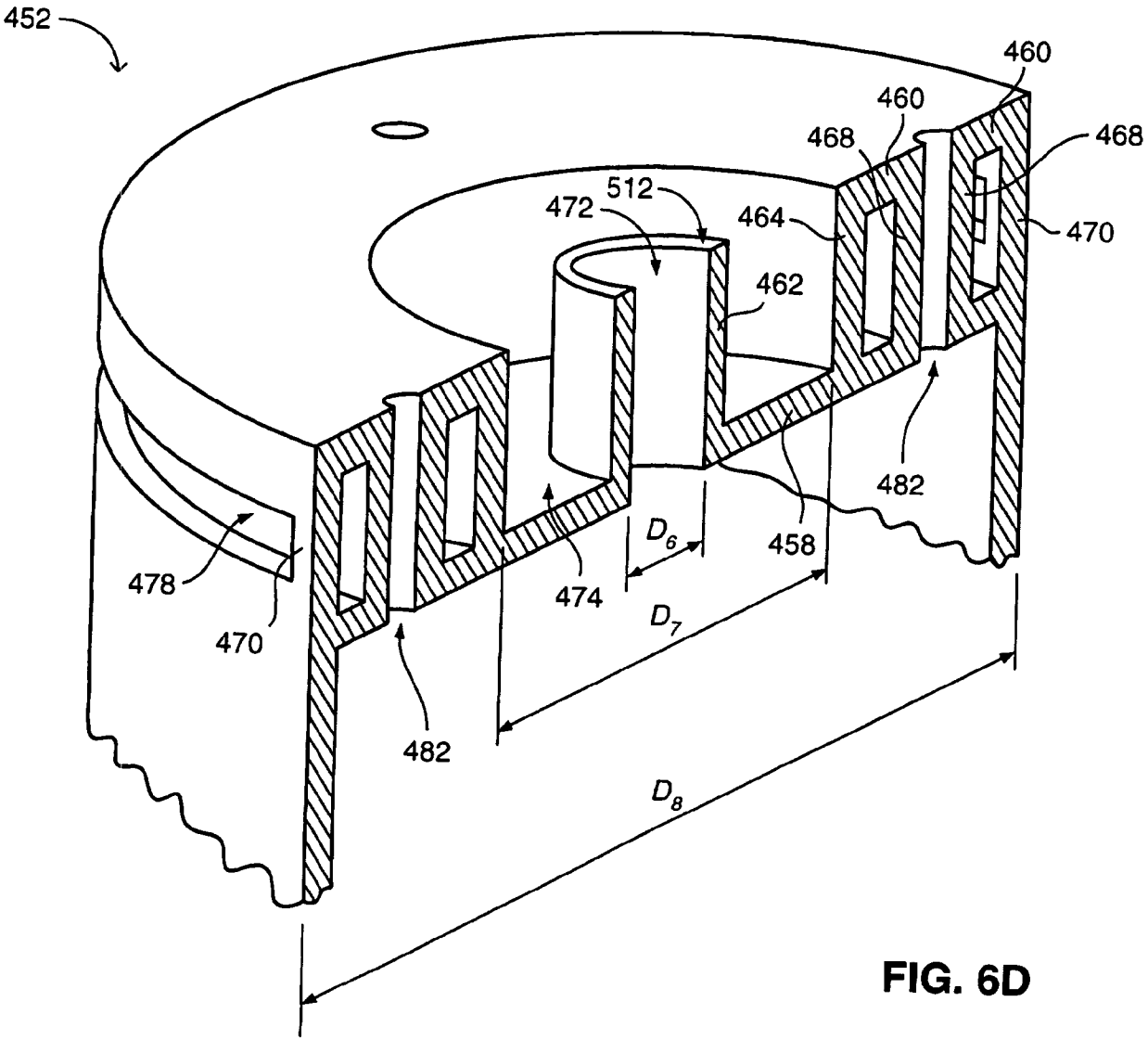
FIG. 6D is a schematic illustration of a perspective of the side cross section of the dispenser of FIG. 6A.
Figure 6E:
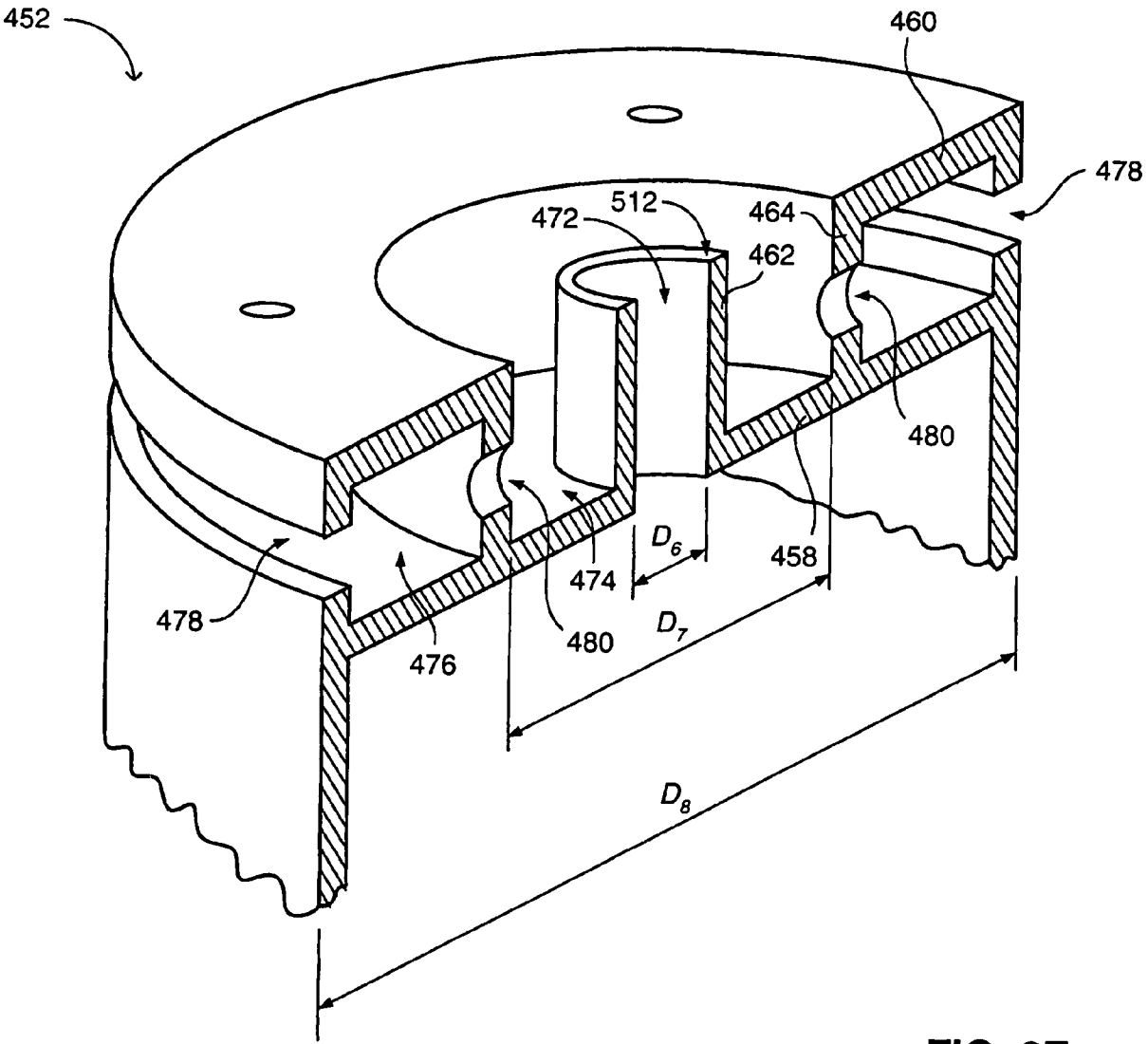
FIG. 6E is a schematic illustration of a perspective of the side cross section of the dispenser of FIG. 6B.
Figure 6F:
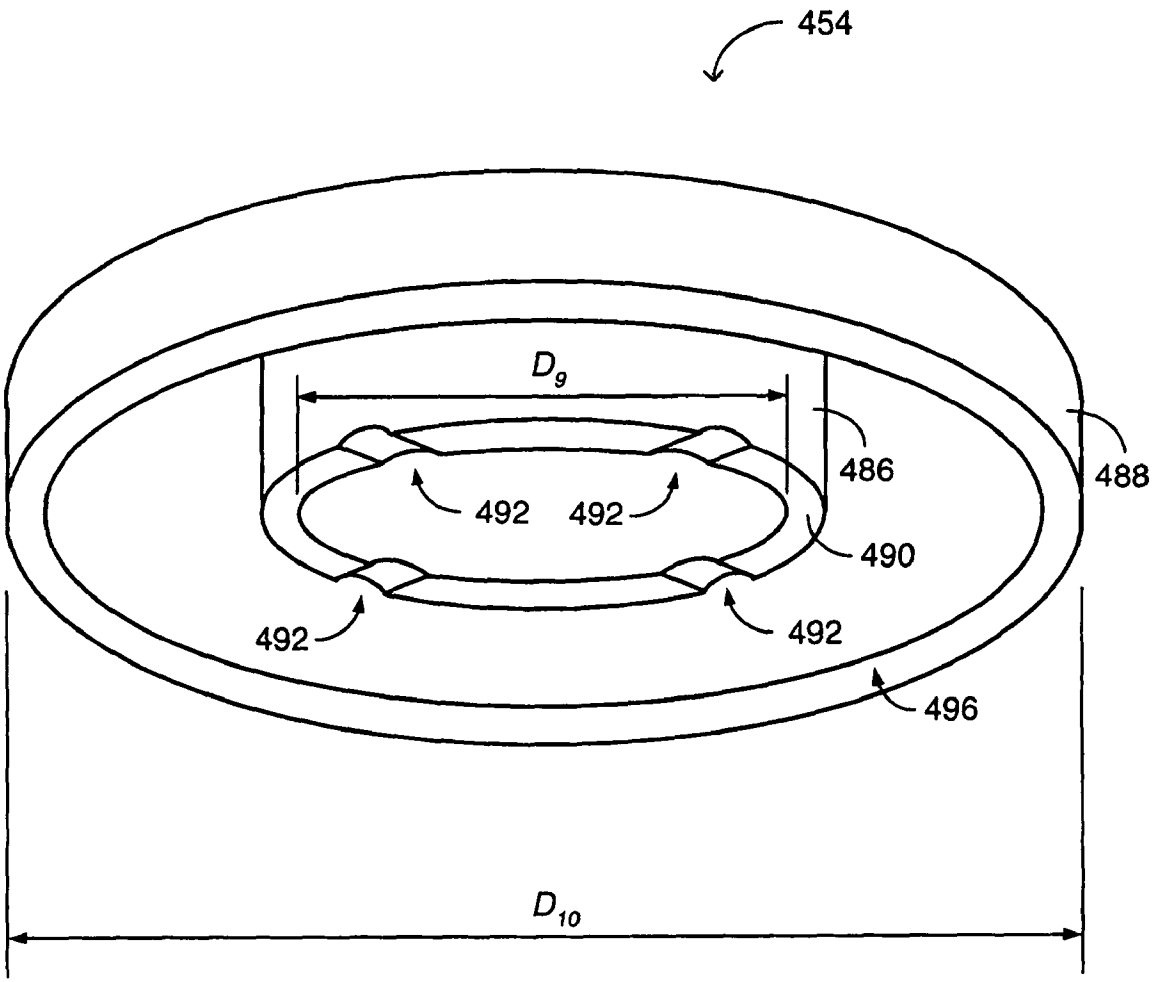
FIG. 6F is a schematic illustration of a perspective from the bottom of a cover of the dispenser of FIGS. 6A and 6B.
Figure 6G:
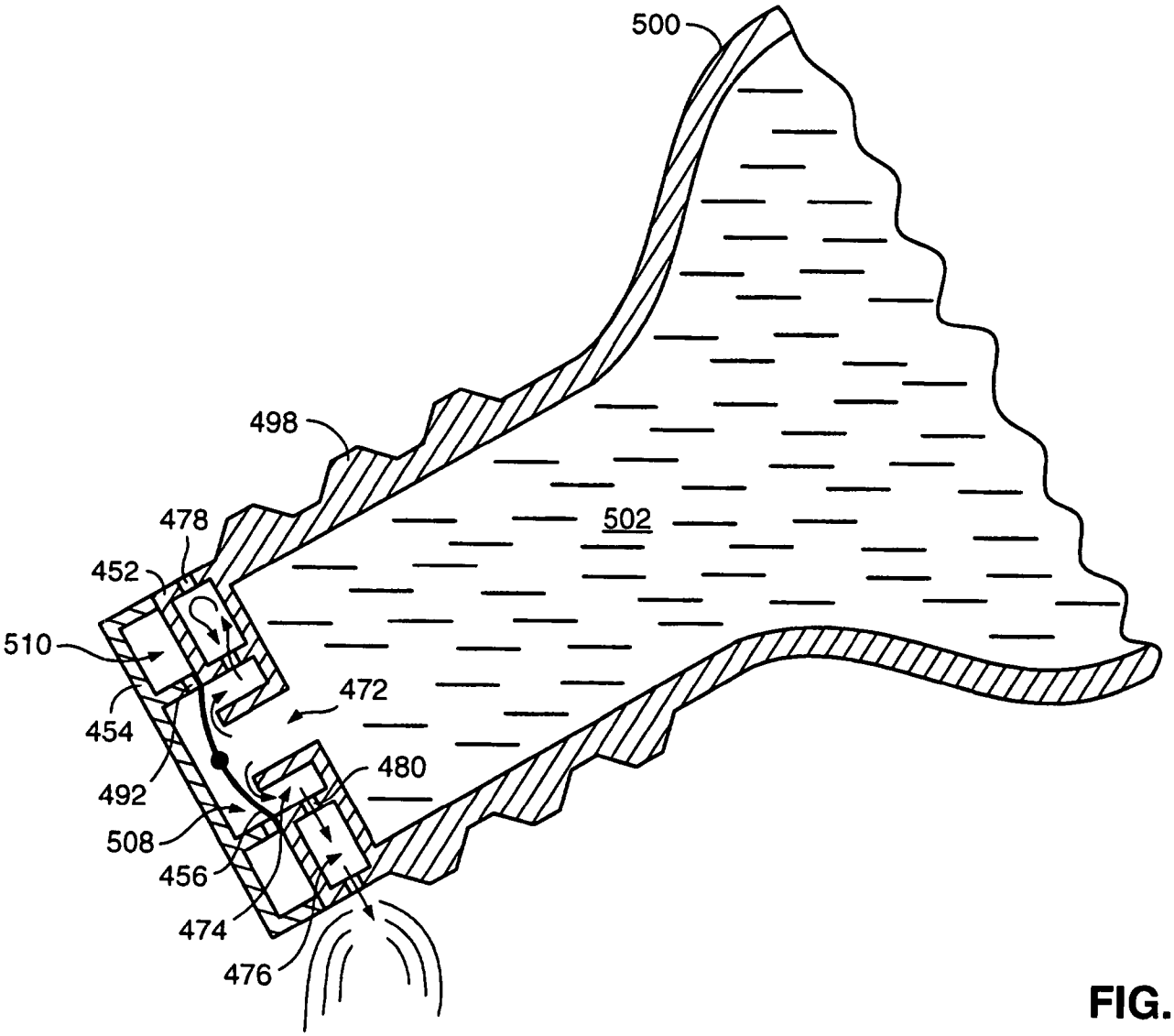
FIG. 6G is a schematic illustration of the dispenser of FIG. 6A in a dispensing mode.

Reference is now made to FIGS. 6A, 6B, 6C, 6D, 6E, 6F and 6G. FIG. 6A is a schematic illustration of a side cross section of a dispenser in a closed mode, generally referenced 450, constructed and operative in accordance with a further embodiment of the disclosed technique. FIG. 6B is a schematic illustration of another side cross section of the dispenser of FIG. 6A. FIG. 6C is a schematic illustration of a top cross section (cross section A-A) of the dispenser of FIGS. 6A and 6B. FIG. 6D is a schematic illustration of a perspective of the side cross section of the dispenser of FIG. 6A. FIG. 6E is a schematic illustration of a perspective of the side cross section of the dispenser of FIG. 6B. FIG. 6F is a schematic illustration of a perspective from the bottom of a cover of the dispenser of FIGS. 6A and 6B. FIG. 6G is a schematic illustration of the dispenser of FIG. 6A in a dispensing mode.

With reference to FIGS. 6A, 6B, 6C, 6D, 6E and 6F, dispenser 450 includes a neck section 452, a cover 454 and a diaphragm 456 (i.e., an elastic valve or a membrane). Neck section 452 includes a lower annulus 458, an upper annulus 460, an inner annular wall 462, an outer annular wall 464, a plurality of inner ribs 468 and a plurality of outer ribs 470. Lower annulus 458 and upper annulus 460 are coupled by outer annular wall 464, inner ribs 468 and by outer ribs 470. Inner annular wall 462 extends from lower annulus 458. The inner diameter of inner annular wall 462 is referenced $D_6$, the inner diameter of outer annular wall 464 is referenced $D_7$, and the outer diameter of upper annulus 460 is referenced $D_8$, such that, $$D_7 > D_6 \tag{14}$$

and $$D_8 > D_7 \tag{15}$$

The space within inner annular wall 462 forms a base opening 472. The space between inner annular wall 462 and outer annular wall 464 forms a diaphragm-base chamber 474. A base intermediate chamber 476 is formed between lower annulus 458, upper annulus 460, outer annular wall 464, inner ribs 468 and outer ribs 470. A plurality of openings 478 are formed between every pair of outer ribs 470. Outer annular wall 464 is provided with a plurality of holes 480. Each of inner ribs 468 is provided with a hole 482, which passes from lower annulus 458 to upper annulus 460.

Cover 454 includes a head portion 484, an inner annular wall 486 and an outer annular wall 488. Inner annular wall 486 and outer annular wall 488 extend from head portion 484. An edge 490 (i.e., a compartment sealing region) of inner annular wall 486 is provided with a plurality of notches 492. The cross section of each of notches 492 can be semi-circular, elliptical, or polygonal, such as square, rectangle, triangle, and the like. Diaphragm 456 includes a body 494 (i.e., massive body). The inner diameter of inner annular wall 486 is referenced $D_9$, the outer diameter of outer annular wall 488 is referenced $D_{10}$ and the diameter of diaphragm 456 is referenced $D_{11}$, such that, $$D_{10}>D_9 \tag{16}$$

$$D_{11}>D_7 \tag{17}$$

$$D_9 \geqq D_7 \tag{18}$$

$$D_9>D_6 \tag{19}$$

and $$D_{10} \approx D_8 \tag{20}$$

Each of neck section 452, cover 454 and diaphragm 456 has a substantially circular cross section. However, it is noted that the cross section of each of neck section 452, cover 454 and diaphragm 456 can be non-circular, such as ellipse, square, rectangular, triangular, polygonal, and the like.

Each of neck section 452 and cover 454 is made of a polymer, such as injection molded plastic, a molded metal, such as zinc die casting, and the like. Neck section 452 can be made of two parts which are fastened together at cross section A-A. Diaphragm 456 is made of a substantially thin and flexible material, such as natural rubber, synthetic rubber, urethane, silicone (i.e., a polymer), and the like. Each of neck section 452, cover 454, diaphragm 456 and body 494 is made of a nontoxic material. The specific gravity of body 494 is substantially greater than that of diaphragm 456.

Cover 454 is coupled with neck section 452, such that edge 490 and an edge 496 of outer annular wall 488, make contact with upper annulus 460. Cover 454 and neck section 452 can be coupled together by fastening methods known in the art, such as by an adhesive, ultrasonic welding, brazing (for metallic parts), welding, electromagnetic forming, and the like. Diaphragm 456 is located between edge 490 and upper annulus 460.

Neck section 452 is coupled with a neck 498 of a container 500. Alternatively, neck section 452 is integral with neck 498. Container 500 contains a carbonated liquid 502 and a gas 504 at a pressure P, fills a neck space 506, defined by an inner wall (not shown) of neck 498, lower annulus 458 and carbonated liquid 502.

A diaphragm-cover chamber 508 (i.e., a compartment) is formed between head portion 484, inner annular wall 486 and diaphragm 456. The space between head portion 484, inner annular wall 486, outer annular wall 488 and upper annulus 460 forms a cover intermediate chamber 510.

Neck space 506 communicates with cover intermediate chamber 510 through holes 482. Cover intermediate chamber 510 communicates with diaphragm-cover chamber 508 through notches 492. Thus, neck space 506 communicates with diaphragm-cover chamber 508, through holes 482, cover cavity 510 and notches 492 (which together form a fluid channel).

Diaphragm-base chamber 474 communicates with base intermediate chamber 476 through holes 480. Base intermediate chamber 476 is open to the atmosphere through openings 478. Thus, diaphragm-base chamber 474 is open to the atmosphere through holes 480, base intermediate chamber 476 and openings 478.

A force $F_6$ (not shown) acts on diaphragm 456, as a result of pressure P of gas 504 on an area $S_6$ (not shown) of diaphragm 456 defined by inner diameter $D_6$. A force $F_9$ (not shown) acts on diaphragm 456, as a result of pressure P of gas 504 on an area $S_9$ (not shown) of diaphragm 456 defined by inner diameter $D_9$. A force W (not shown) due to the weight of body 494 acts on diaphragm 456. The force $F_6$ tends to lift diaphragm 456 off of an edge 512 (i.e., a container sealing region) of inner annular wall 462. The forces $F_6$ and W tend to seal diaphragm 456 against edge 512.

Since according to Equation 19, $$S_9>S_6 \tag{21}$$

then, $$F_9>F_6 \tag{22}$$

Thus, a net force $$F_n=F_9+W-F_6 \tag{23}$$

causes diaphragm 456 to seal against edge 512, thereby preventing gas 504 to escape container 500.

With reference to FIG. 6G, container 500 is tilted at a pouring angle (not shown), wherein carbonated liquid 502 enters base opening 472 and the weight of carbonated liquid 502 in base opening 472 lifts diaphragm 456 off of edge 512. Gas 504 which fills a bottom space (not shown) of container 500, forces carbonated liquid 502 out of openings 478, through diaphragm-base chamber 474, holes 480 and base intermediate chamber 476.

During emergence of carbonated liquid 502 through openings 478, a portion of carbonated liquid 502 enters diaphragm-cover chamber 508, through holes 482, cover intermediate chamber 510 and notches 492. When container 500 is returned to an upright position, such as in FIG. 6A, the weight of this portion of carbonated liquid 502 confined within diaphragm-cover chamber 508, together with the force $F_n$ (Equation 23) cause diaphragm 456 to seal against edge 512, thereby keeping gas 504 within container 500.

Figure 7A:
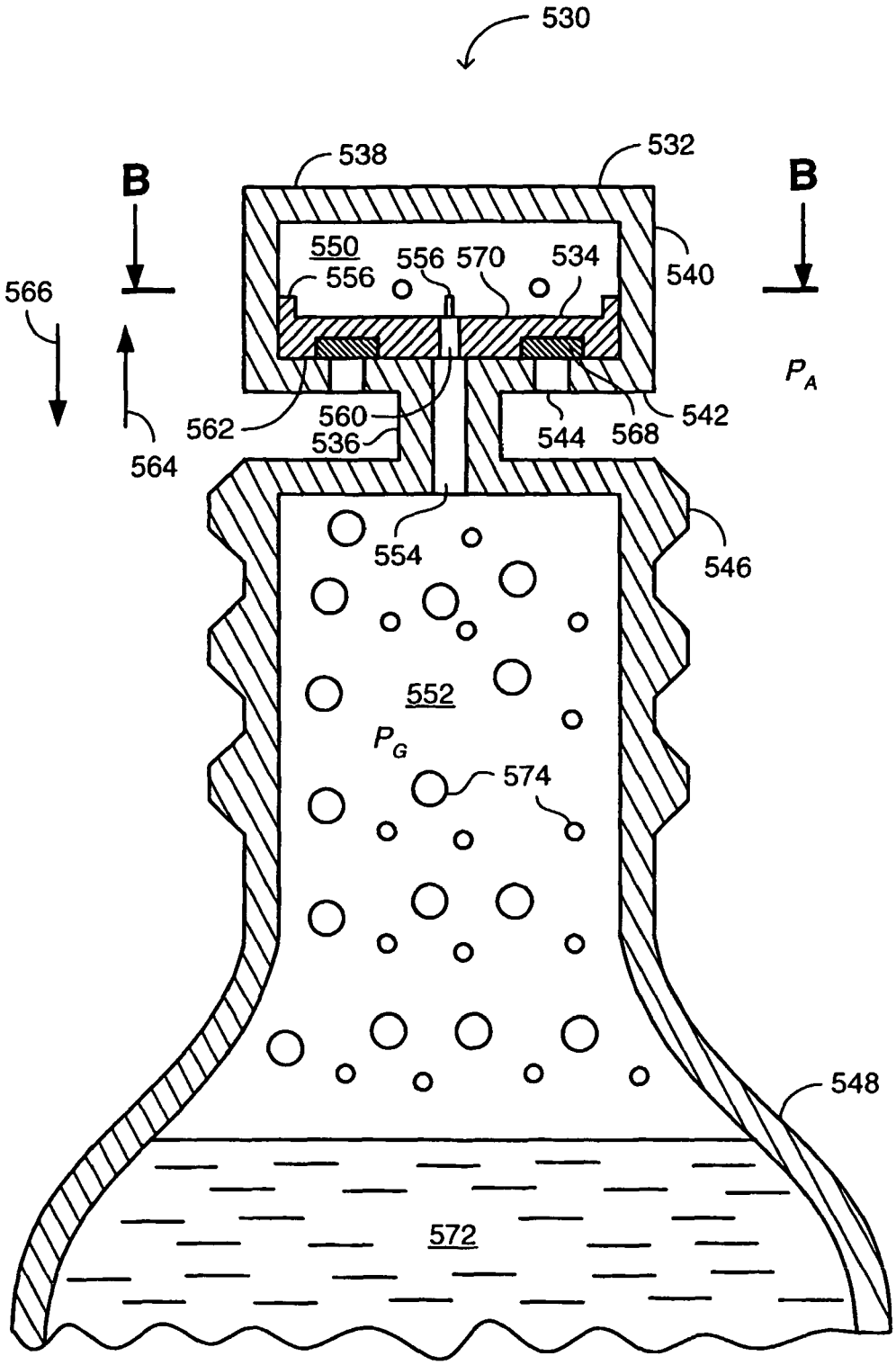
FIG. 7A is a schematic illustration of a cross section of a dispenser in a closed mode, constructed and operative in accordance with another embodiment of the disclosed technique.
Figure 7B:
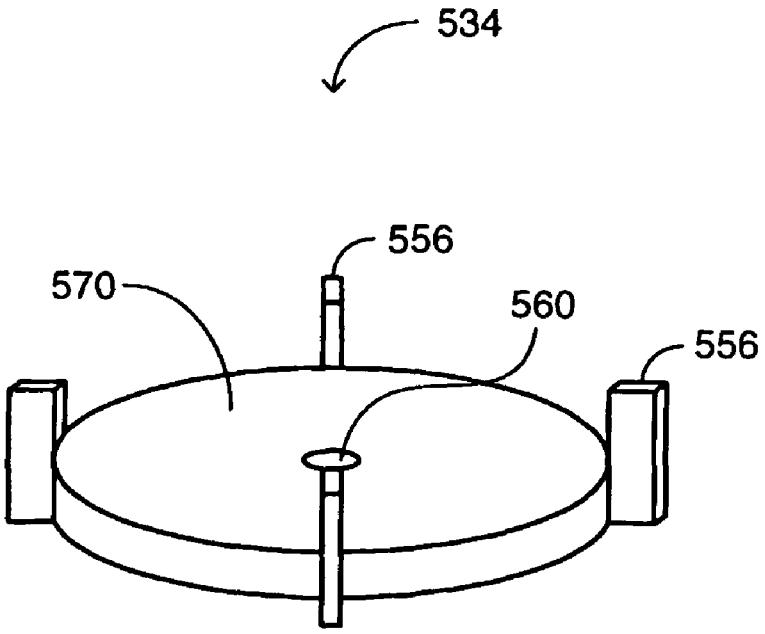
FIG. 7B is a schematic illustration in perspective, of the valve element of the dispenser of FIG. 7A.
Figure 7C:
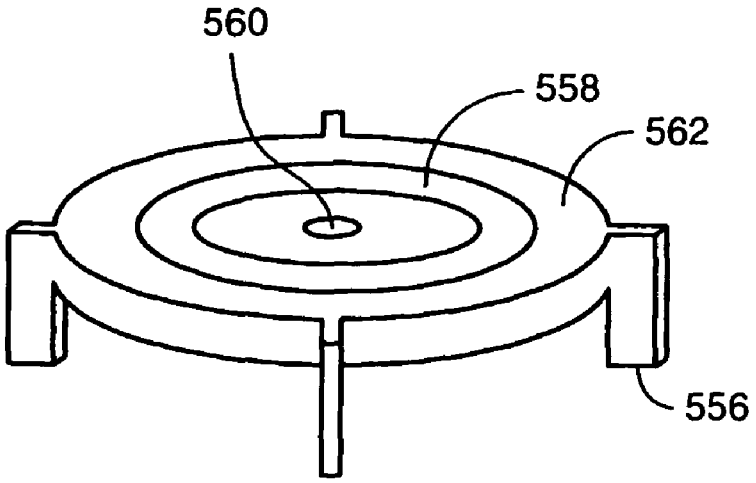
FIG. 7C is a schematic illustration in perspective, of the valve element of the dispenser of FIG. 7A at another view.
Figure 7D:
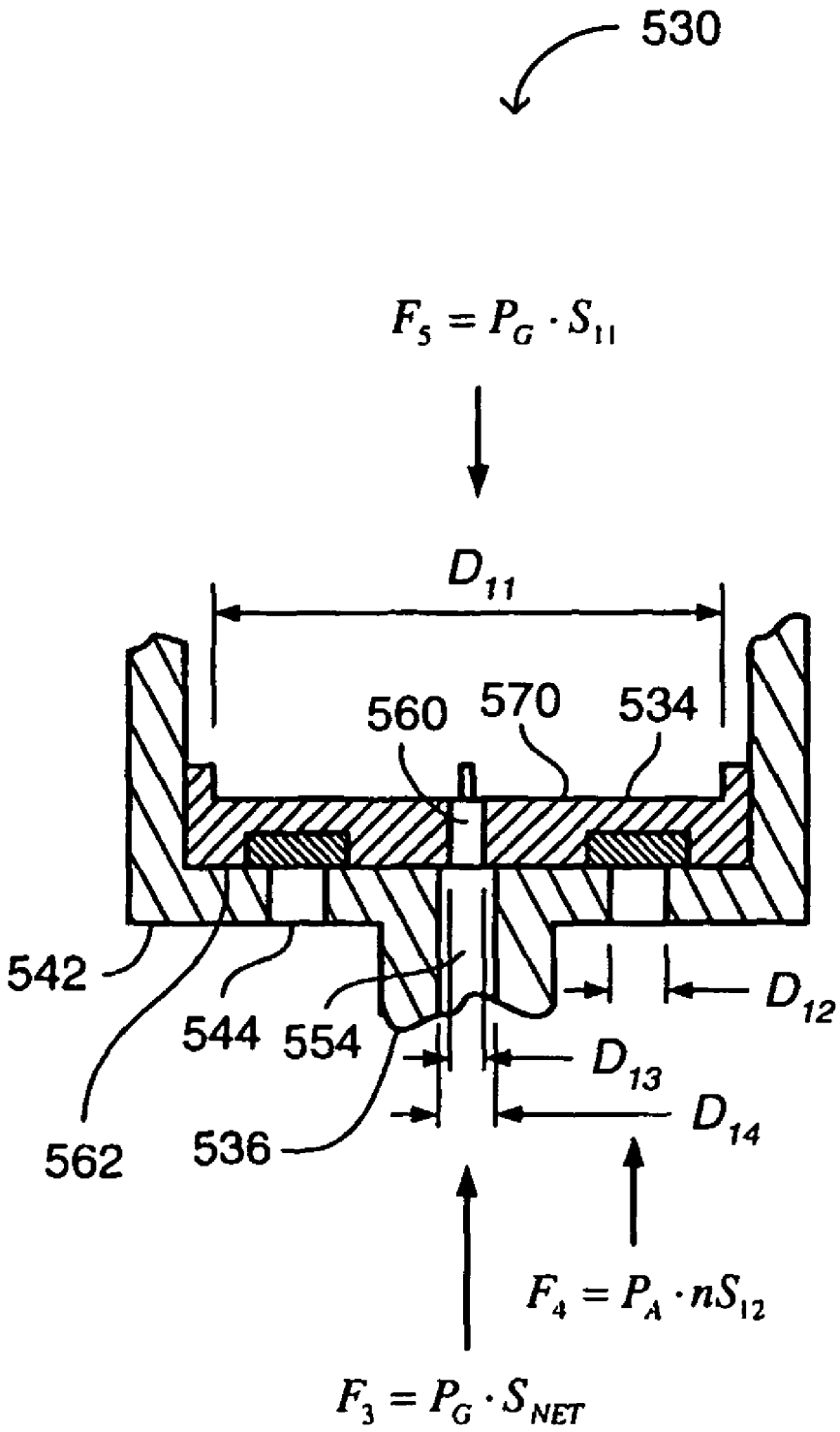
FIG. 7D is a schematic illustration of a section of the dispenser of FIG. 7A.
Figure 7E:
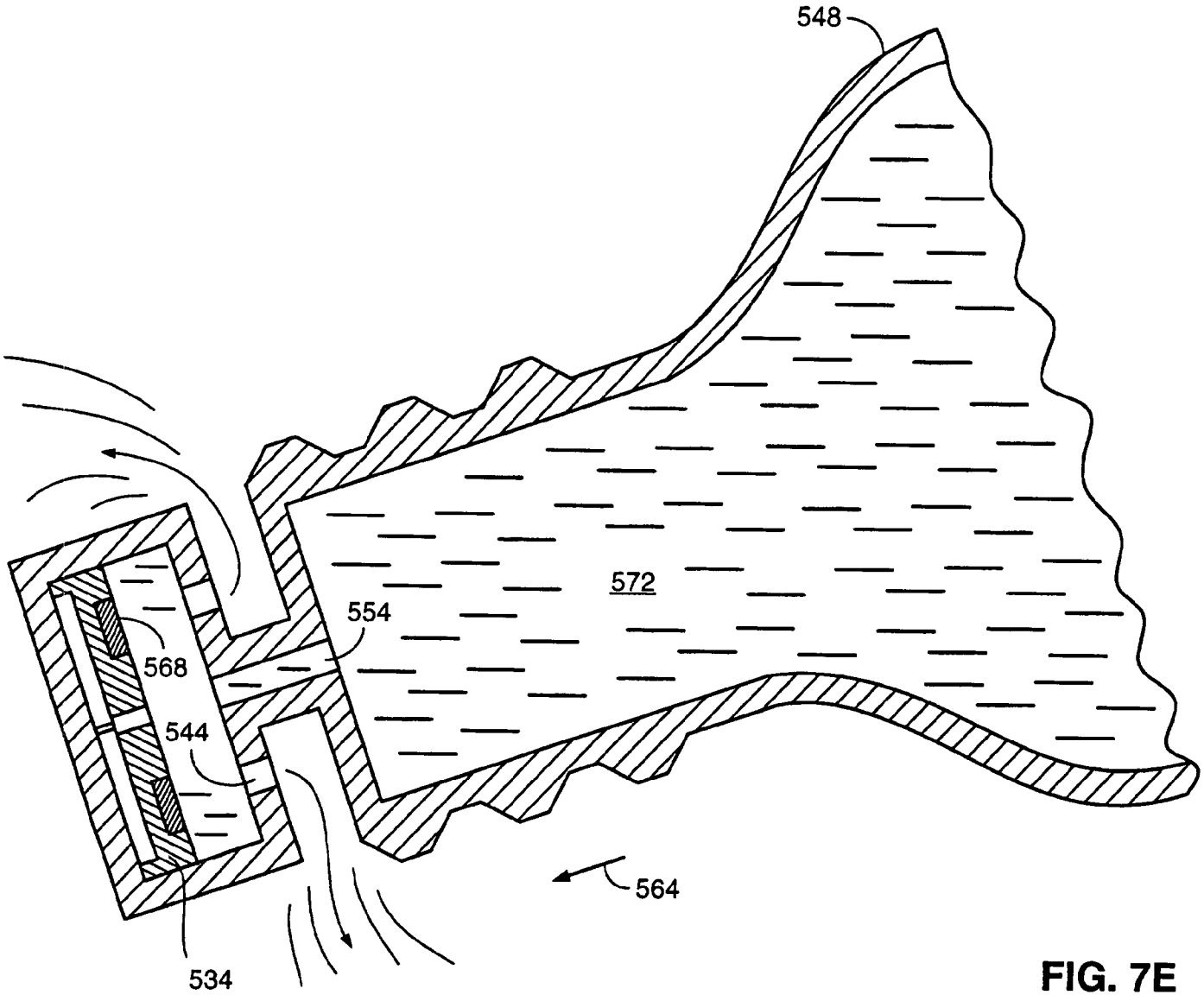
FIG. 7E is a schematic illustration of the dispenser of FIG. 7A, in a dispensing mode.

Reference is now made to FIGS. 7A, 7B, 7C, 7D and 7E. FIG. 7A is a schematic illustration of a cross section of a dispenser in a closed mode, generally referenced 530, constructed and operative in accordance with another embodiment of the disclosed technique. FIG. 7B is a schematic illustration in perspective, of the valve element of the dispenser of FIG. 7A. FIG. 7C is a schematic illustration in perspective, of the valve element of the dispenser of FIG. 7A at another view. FIG. 7D is a schematic illustration of a section of the dispenser of FIG. 7A. FIG. 7E is a schematic illustration of the dispenser of FIG. 7A, in a dispensing mode.

With reference to FIG. 7A, dispenser 530 includes a compartment 532, a valve element 534 and a tubing section 536. Compartment 532 includes a cover 538, a side wall 540 and a bottom 542. The cross section of compartment 532 along section B-B is preferably circular, however this cross section can be in the form of any polygon or closed curve, such as square, rectangle, triangle, ellipse, and the like.

Bottom 542 is provided with a plurality (n) of openings 544. Tubing section 536 couples bottom 542 with a neck 546 of a container 548. Thus, a compartment space 550 of compartment 532 communicates with a neck space 552 of container 548 via a passageway 554 of tubing section 536.

With further reference to FIGS. 7B and 7C, valve element 534 includes a plurality of ribs 556 at a periphery thereof, and an annular groove 558. Valve element 534 is provided with an opening 560 approximately at a center (not shown) thereof. Annular groove 558 is located at a bottom surface 562 of valve element 534. Valve element 534 is located within compartment 532, such that bottom surface 562 faces openings 544.

The circumference of valve element 534 is similar to that of an inner circumference (not shown) of side wall 540, such that valve element 534 can move within compartment space 550 in directions designated by arrows 564 and 566. Ribs 556 guide valve element 534 to move within compartment space 550. However, the valve element can be devoid of the ribs, wherein the circumference of the valve element is of such size to allow sliding motion of the valve element against the inner circumference of the side wall.

Cover 538 is fastened to side wall 540 after inserting valve element 534 in compartment space 550. Alternatively, bottom 542 is fastened to side wall 540 after inserting valve element 534 in compartment space 550. Side wall 540, tubing section 536 and neck 546 can be all be the same part. Alternatively, any of side wall 540, tubing section 536 and neck 546 can be a separate part, and fastened together by an adhesive, by vibration welding, thermal welding, and the like.

Annular groove 558 is filled with a sealing element 568. A contour of annular groove 558 is such that when a force acts on a top surface 570 of valve element 534, sealing element 568 seals openings 544. Alternatively, the valve element can be devoid of the annular groove and the sealing element, in which case the bottom surface of the valve element alone, seals against the openings of the bottom of the compartment.

Opening 560 is located such that compartment space 550 can communicate with neck space 552, through opening 560 and passageway 554. Container 548 contains a carbonated liquid 572 and neck space 552 contains a gas 574 at a pressure $P_G$. The pressure $P_G$ is substantially greater than the atmospheric pressure $P_A$.

With reference to FIG. 7D, the diameter of top surface 570 is designated $D_{11}$, the diameter of each of openings 544 $D_{12}$, the diameter of opening 560 $D_{13}$, and the diameter of passageway 554 $D_{14}$. The base (not shown) of opening 560, corresponding to diameter $D_{13}$ defines a surface area $S_{13}$. The net surface area of top surface 570 after subtracting $S_{13}$ from the total surface area of top surface 570 defined by $D_{11}$, is designated $S_{11}$. The base (not shown) of each the openings 544, corresponding to diameter $D_{12}$, defines a surface area $S_{12}$. The base (not shown) of passageway 554, corresponding to diameter $D_{14}$, defines a surface area $S_{14}$. When container 548 is in an upright position as illustrated in FIG. 7A, valve element 534 drops down within compartment space 550 (FIG. 7A) due to the force of gravity $M_v g$, and the pressure in compartment space 550 equalizes to $P_G$.

In the example set forth in FIG. 7D, $$S_{13}<S_{14} \tag{24}$$

The difference between $S_{13}$ and $S_{14}$ is designated $S_{NET}$. The force acting on bottom surface 562 due to the surface area $S_{NET}$ and the gas pressure $P_G$, is $$F_3=P_G \cdot S_{NET} \tag{25}$$

The surface area of bottom surface 562 which is exposed to the atmospheric pressure $P_A$, is defined by the sum of surface areas of openings 544 (i.e., $nS_{12}$). The force acting on bottom surface 562 due to surface area $nS_{12}$ and the atmospheric pressure $P_A$, is $$F_4=P_A \cdot nS_{12} \tag{26}$$

and the force acting on top surface 570 due to the net surface area $S_{11}$ and the gas pressure $P_G$, is $$F_5=P_G \cdot S_{11} \tag{27}$$

Since, $$S_{11}>S_{NET} \tag{28}$$

and $$P_G>P_A \tag{29}$$

then, $$F_5>F_3 \tag{30}$$

and since, $$S_{11}>nS_{12} \tag{31}$$

then, $$F_5>F_4 \tag{32}$$

The diameters $D_{12}$, $D_{13}$, and $D_{14}$ are selected such that $$F_5+M_v g>F_4+F_3 \tag{33}$$

Thus, valve element 534 is forced toward openings 544 along arrow 566 (FIG. 7A), wherein sealing element 568 seals openings 544 and prevents gas 574 to escape from neck space 552.

With reference to FIG. 7E, container 548 is tilted at a pouring angle (not shown). At this pouring angle, carbonated liquid 572 flows through passageway 554 and the weight of carbonated liquid 572 forces valve element 534 to move in direction 564. Sealing element 568 lifts off openings 544 thereby allowing carbonated liquid 572 to pour out of container 548, through openings 544.

It is noted with reference to FIG. 7D, that if $$D_{13} \geqq D_{14} \tag{34}$$

then $S_{NET}=0$, and $F_3=0$, and Equation 33 still holds.

Figure 8:
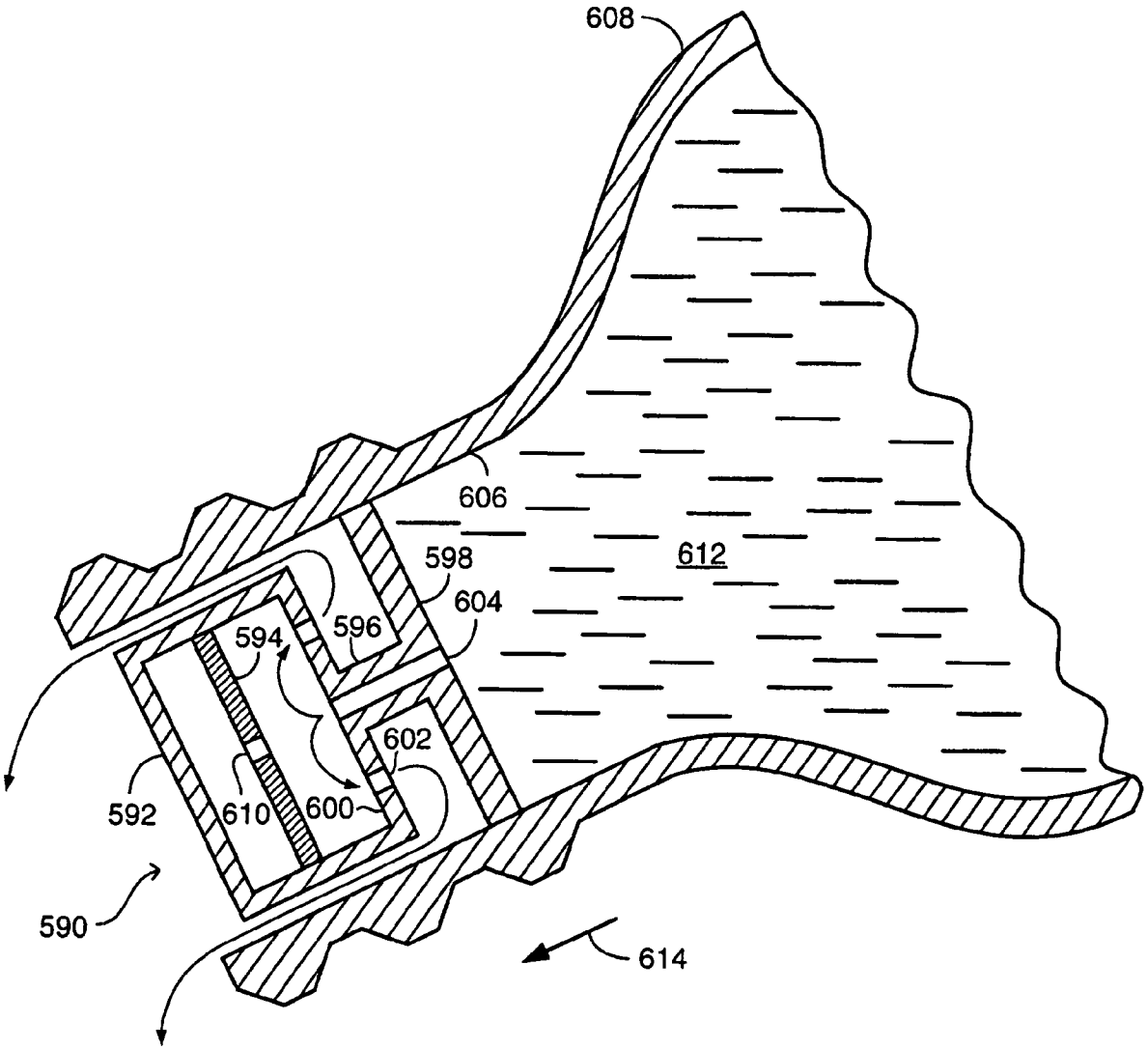
FIG. 8 is a schematic illustration of a cross section of a dispenser in a dispensing mode, constructed and operative in accordance with a further embodiment of the disclosed technique.

Reference is now made to FIG. 8, which is a schematic illustration of a cross section of a dispenser in a dispensing mode, generally referenced 590, constructed and operative in accordance with a further embodiment of the disclosed technique. Dispenser 590 includes a compartment 592, a valve element 594, a tubing section 596, and a plate section 598. Compartment 592 includes a bottom 600. Bottom 600 is provided with a plurality of openings 602. Tubing section 596 couples bottom 600 with plate section 598. Tubing section 596 includes a passageway 604. Plate section 598 is coupled with an inner wall 606 of a container 608, by fastening methods known in the art, such as an adhesive, ultrasonic welding, thermal welding, snap-in connection, and the like. Valve element 594 is in form of a disk and is provided with an opening 610. Container 608 includes a carbonated liquid 612.

Container 608 is tilted at a pouring angle (not shown). At this pouring angle, carbonated liquid 612 flows through passageway 604 and the weight of carbonated liquid 612 forces valve element 594 to move in a direction designated by an arrow 614. Valve element 594 lifts off openings 602 thereby allowing carbonated liquid 612 to pour out of container 608, through passageway 604 and openings 602.

Alternatively, the cross section of the valve element is any polygon or closed curve, such as square, rectangle, triangle, ellipse, and the like. Accordingly, the cross section of the inner wall of the compartment can for example be made in a shape which matches the cross section of the valve element.

It will be appreciated by persons skilled in the art that the disclosed technique is not limited to what has been particularly shown and described hereinabove. Rather the scope of the disclosed technique is defined only by the claims, which follow.

The invention claimed is:

1. Liquid dispenser for dispensing a carbonated liquid from a container by tilting the container to a pouring position, the liquid dispenser comprising:

a compartment extending upwardly from a neck portion of said container, defining an opening to the atmosphere between said compartment and said neck portion;

a container sealing region located between said neck portion and said opening;

a compartment sealing region located between said compartment and said opening; and a valve, movable within said compartment, from a closed position pressed toward said neck portion, and to an open position, away from said neck portion, said valve comprising:

a first surface facing said compartment;

a second surface facing said opening;

a first valve sealing region to match said container sealing region, for preventing passage of fluids between said neck portion and said opening, when said valve is in said closed position;

a second valve sealing region to match said compartment sealing region, for preventing passage of fluids between said compartment and said opening, when said valve is in said closed position; and a channel extending from said neck portion to said compartment, said channel enabling passage of fluid from said neck portion to said compartment at the closed position of said valve;

wherein pressure within said container and pressure within said compartment are substantially similar.

2. Liquid dispenser for dispensing a carbonated liquid from a container by tilting the container to a pouring position, the liquid dispenser comprising:

a compartment extending upwardly from a neck portion of said container, defining an opening to the atmosphere between said compartment and said neck portion;

a container sealing region located between said neck portion and said opening;

a compartment sealing region located between said compartment and said opening; and a valve, movable within said compartment, from a closed position pressed toward said neck portion, and to an open position, away from said neck portion, said valve comprising:

a first surface facing said compartment;

a second surface facing said opening;

a first valve sealing region to match said container sealing region, for preventing passage of fluids between said neck portion and said opening, when said valve is in said closed position;

a second valve sealing region to match said compartment sealing region, for preventing passage of fluids between said compartment and said opening, when said valve is in said closed position; and a channel extending from said neck portion to said compartment, said channel permanently enabling passage of fluid from said neck portion to said compartment;

wherein when said container is in a generally upright position, said valve is positioned in said closed position, said closed position being characterized by a first sum of a surface force due to a pressure of a gas of said carbonated liquid acting on said first surface, and a valve weight of said valve, being greater than an atmospheric force component opposite to a direction of said first sum, due to the atmospheric pressure acting on said second surface, said direction being substantially parallel with a longitudinal axis of said container and pointing toward a bottom of said container, whereby said opening is closed and said gas remains within said container, and wherein when said container is in a pouring position, a second sum of said valve weight component opposite to said direction, said atmospheric force component opposite to said direction, and a liquid weight component of a weight of said carbonated liquid opposite to said direction, is greater than said surface force, thereby causing said valve to move from said closed position toward said open position.

3. The liquid dispenser according to claim 2, wherein said compartment is coupled with said neck portion by at least one rib, said at least one rib forming at least one opening, said second surface being exposed to said atmosphere through said at least one opening.

4. The liquid dispenser according to claim 3, wherein said at least one rib is made of a flexible material, thereby allowing movement of said compartment sealing region relative to said container sealing region.

5. Liquid dispenser for dispensing a carbonated liquid from a container by tilting the container to a pouring position, the liquid dispenser comprising:

a compartment extending upwardly from a neck portion of said container, defining an opening to the atmosphere between said compartment and said neck portion;

a container sealing region located between said neck portion and said opening;

a compartment sealing region located between said compartment and said opening; and a valve, movable within said compartment, from a closed position pressed toward said neck portion, and to an open position, away from said neck portion, said valve comprising:

a first surface facing said compartment;

a second surface facing said opening;

a first valve sealing region to match said container sealing region, for preventing passage of fluids between said neck portion and said opening, when said valve is in said closed position;

a second valve sealing region to match said compartment sealing region, for preventing passage of fluids between said compartment and said opening, when said valve is in said closed position; and a channel extending from said neck portion to said compartment, said channel permanently enabling passage of fluid from said neck portion to said compartment;

wherein said valve is in a form of a prism whose lateral face tapers from a base into an apex, said first surface being located at said base, said second surface being located on said lateral face, wherein said second surface includes said first valve sealing region and said second valve sealing region, and wherein said base is located within said compartment, an apex of said prism is located within said neck portion.

6. The liquid dispenser according to claim 5, wherein said valve further includes a third surface located at said apex, said first surface being larger than said third surface, said channel connecting said first surface with said third surface.

7. The liquid dispenser according to claim 1, wherein said valve is in form of a bobbin, said bobbin having a first base, a second base and a lateral portion located between said first base and said second base, said first base being larger than said second base, wherein said channel passes through said lateral portion, said channel connects said first base with said second base, wherein said first surface is located on a first outer portion of said first base, farthest from said lateral portion, wherein a lateral face of said lateral portion includes said second surface, wherein said first valve sealing region is located on a second outer portion of said second base farthest from said lateral portion, and wherein said second valve sealing region is located on an inner portion of said first base closest to said lateral portion.

8. The liquid dispenser according to claim 1, wherein said compartment is coupled with said neck portion via a passageway, wherein said valve is located within said compartment, wherein said compartment includes at least one opening, wherein said valve is in form of a prism whose first base and second base are substantially similar and parallel, wherein said first base includes said first surface, wherein said second base includes said second surface, said second surface being determined according to a cross section of said at least one opening, said second surface being exposed to said atmosphere through said at least one opening, wherein said first valve sealing region and said second valve sealing region are located on said second base, and wherein said channel connects said first base with said second base.

9. The liquid dispenser according to claim 8, wherein said second base includes a sealing element, said sealing element includes said first valve sealing region and said second valve sealing region.

10. The liquid dispenser according to claim 1, wherein said first valve sealing region and said second valve sealing region are made of a material flexible enough, to effectively seal said container sealing region and said compartment sealing region, respectively.

11. The liquid dispenser according to claim 1, wherein said valve is made of a polymer.

12. The liquid dispenser according to claim 1, further comprising a guiding element for guiding said valve within said compartment.

* * * * *